US012662896B2

(12) United States Patent
Dachepally et al.

(10) Patent No.: US 12,662,896 B2
(45) Date of Patent: Jun. 23, 2026

(54) REINFORCED SWELL PACKER FOR WELLBORES

(71) Applicant: Halliburton Energy Services, Inc., Houston, TX (US)

(72) Inventors: Nithin Kumar Gupta Dachepally, Singapore (SG); Ramya Priyadarsini Selvamurugan, Singapore (SG); Mohan Gunasekaran, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/982,192

(22) Filed: Dec. 16, 2024

(65) Prior Publication Data

US 2026/0168348 A1 Jun. 18, 2026

(51) Int. Cl.
*E21B 33/12* (2006.01)
*E21B 23/06* (2006.01)

(52) U.S. Cl.
CPC ..... *E21B 33/1208* (2013.01); *E21B 23/06* (2013.01)

(58) Field of Classification Search
CPC ..... E21B 33/1208; E21B 23/06
See application file for complete search history.

(56) References Cited

U.S. PATENT DOCUMENTS 2,144,026 A * 1/1939 Park ..... E21B 33/1208 277/936
7,422,071 B2 9/2008 Wilkie et al.
11,047,203 B2 6/2021 Fripp et al.
11,268,342 B2 * 3/2022 Andersen ..... E21B 33/1216
2008/0078561 A1 4/2008 Chalker et al.
2009/0211770 A1 * 8/2009 Nutley ..... E21B 33/1208 294/86.26
2009/0242215 A1 * 10/2009 Eatwell ..... E21B 33/128 166/387
2009/0272525 A1 11/2009 Nutley et al.
2010/0276137 A1 * 11/2010 Nutley ..... E21B 33/1216 166/185
2010/0294484 A1 * 11/2010 Castillo ..... E21B 33/1208 228/115
2012/0073834 A1 * 3/2012 Lembcke ..... E21B 33/1216 166/387
2012/0273119 A1 11/2012 Vaidya et al.
2015/0021044 A1 * 1/2015 Davis ..... E21B 33/1208 166/387
2017/0356269 A1 12/2017 Denton
2020/0370391 A1 * 11/2020 Fripp ..... E21B 33/1212
2020/0399992 A1 * 12/2020 Sevadjian ..... E21B 43/108

OTHER PUBLICATIONS

"PCT Application No. PCT/US2025/010344 International Search Report and Written Opinion", Aug. 28, 2025, 13 pages.

* cited by examiner

*Primary Examiner* — Theodore N Yao
(74) *Attorney, Agent, or Firm* — DeLizio, Peacock, Lewin & Guerra LLP

(57) ABSTRACT

An apparatus comprising a swell packer is described, the swell packer comprising a swellable sealing element comprising one or more layers of a swellable material interlayered with a layer of non-swellable material, the combined layers of material wrapped around the outer surface of a conduit, wherein the swellable material is configured to expand from a non-expanded configuration to an expanded configuration in order to form a seal between the outer surface of the conduit and an inner surface of a wellbore or an inner surface of another conduit such as a wellbore casing.

28 Claims, 16 Drawing Sheets

REINFORCED SWELL PACKER FOR WELLBORES

TECHNICAL FIELD

The disclosure generally relates to the field of wellbore operations, and to reinforced swell packers for use within a wellbore.

BACKGROUND

Packers and plugs are employed in the operation of wellbore systems to separate and provide fluid seals between various zones and/or sections of annulus present within a wellbore. Various operations versions of packers may be used. For example, some packers utilize mechanical compression of a sealing element, such as a rubber seal, to expand the sealing element and thereby form the desired seal between the packer and another surface, such as a surface of a conduit or an inner wall of an open wellbore. Other versions of packers utilize an inflatable elements that is inflated and thereby expanded to form the desired seal. Still another version of a wellbore packer utilizes a swellable material to swell in a downhole fluid to form the sealing element configured to form the desired seal. Each of these types of packers may be employed in a wellbore system based on various factors associated with the operation of the wellbore system and the intended functions that need to be performed by the seal.

BRIEF DESCRIPTION OF THE DRAWINGS

Embodiments of the disclosure may be better understood by referencing the accompanying drawings.

Figure 1:
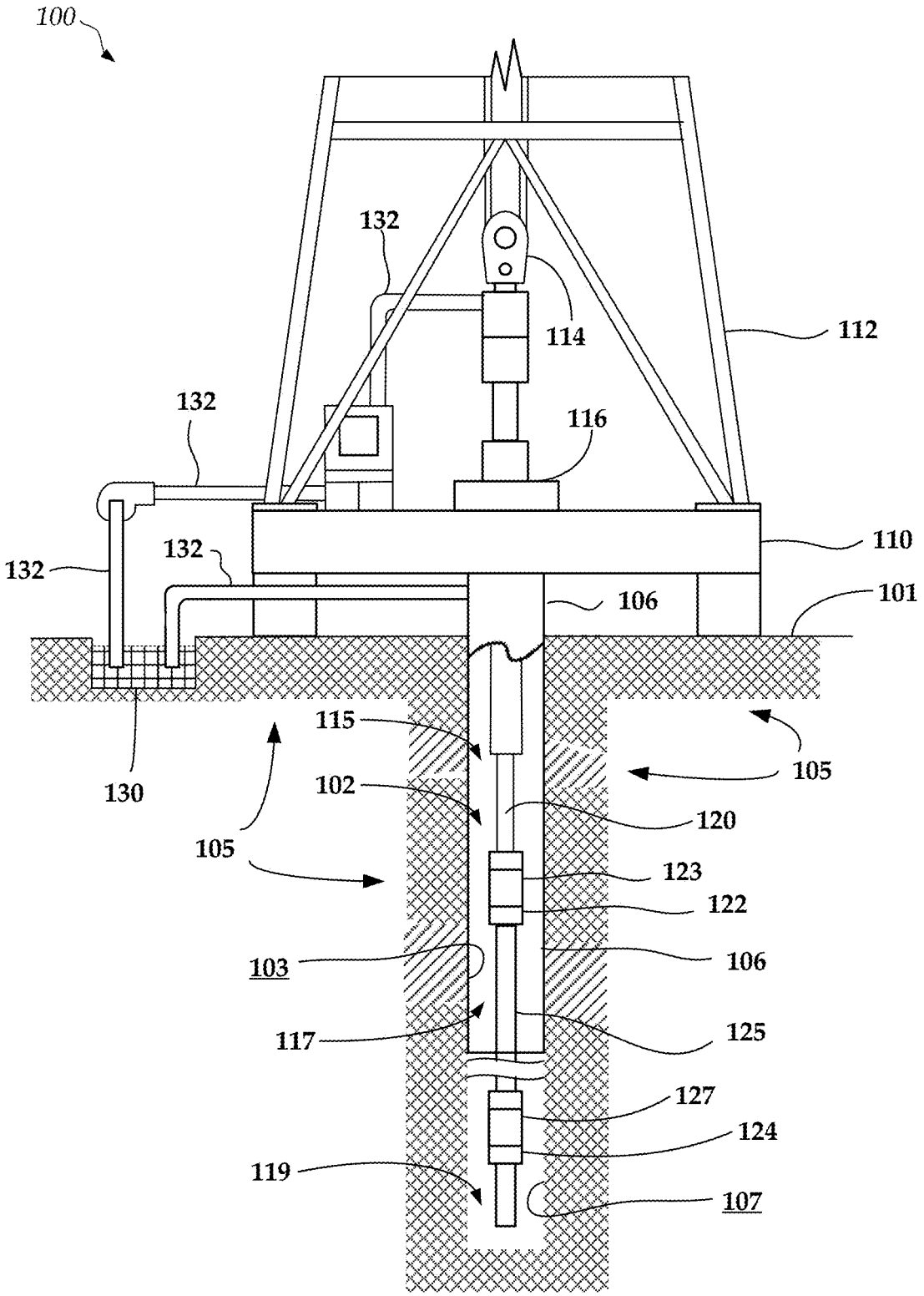
FIG. 1 is a block diagram depicting a wellbore system configured to implement one or more swell packers, in accordance with various embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow like parts are typically marked throughout the specification and drawings with the same or coordinated reference numerals. The drawing figures are not necessarily to scale. Certain features of the invention may be shown to be exaggerated in scale or in somewhat schematic form, and some details of conventional elements may not be shown in the interest of clarity and conciseness.

DETAILED DESCRIPTION

In the following detailed description of the illustrative embodiments, reference is made to the accompanying drawings that form a part hereof. These embodiments are described in sufficient detail to enable those skilled in the art to practice the techniques and methods described herein, and it is understood that other embodiments may be utilized, and that logical structural, mechanical, electrical, and chemical changes may be made without departing from the scope of the disclosure. To avoid detail not necessary to enable those skilled in the art to practice the embodiments described herein, the description may omit certain information known to those skilled in the art. The following detailed description is, therefore, not to be taken in a limiting sense.

The embodiments described herein relate to systems, apparatus, methods, and techniques that may be associated with the use and/or manufacture of reinforced swell packers designed for use downhole in a wellbore. One shortcoming that may arise with existing swell packers is the limited anchor load capacity of the swell packers in an open borehole. Advantages of the reinforced swell packers as described herein include a cost-effective solution for this issue of limited anchoring capacity in open borehole applications. Embodiments of the swell packers as disclosed herein include incorporation of a Reinforcing metal sheet layered into the swellable sealing material of the swell packer. Embodiments included the sheet of the swellable sealing element (also referred to as a calender sheet), backed up with a thin metal sheet with spikes or roughened surface at the end and wrapped like a coil around the conduit of the swell packer. When the swellable sealing element is exposed to a suitable activation fluid, it swells and uncoils similar to a torsional spring. As it uncoils the outer metal surface with spikes come into contact with the inside adjacent surface, such as the wall of an open borehole, or an inner surface of a casing, creating good grip and high anchor force between the conduit of the swell backer and the adjacent surface. The arrangement of swellable sealing material that is reinforced with the reinforcement layer, such as a layer of sheet metal, improves the anchoring load capacity of the reinforced swell packer, along with providing additional resistance to physical damage, such as tearing, which could occur to an unreinforced sealing element of a swell packer during the differential pressure holding period. Thus, the reinforced swellable packers as described herein, and any equivalents thereof, provide one or more improvements to the field of swellable packers for wellbore operation.

Embodiments of the reinforced swell packers as described herein consists of sheets of the swellable sealing material, such as a swellable rubber, which are reinforced with in some embodiments a metal sheet, for example including one rotation longer on one side, and having had a lubricant applied on the other side to allow smooth unwrapping of the sheet during activation of the swell packer. This "sandwich" of the swellable sealing element and the reinforcement layer is wrapped around the base pipe, i.e., a conduit, and is secured in place between a pair of end caps. An additional length of the reinforcement or metal sheet layer that wraps around the outside diameter of the swellable sealing element is configured to have rough surface, the rough surface configured to provide better grip on the open hole inside surface when the swell packer has been activated and thereby expands to come into sealing contact with the inside surface. When the swellable sealing material comes into contact with suitable activation fluid, the swellable sealing material unwraps as it expands, and the outer rough metal surface comes into contact with the inner surface of the open borehole, and thereby provides a better grip with the open hole portion of a wellbore, or with an inner surface of a conduit such as a casing where the swell packer is positioned.

In various embodiments holes and/or cuts of different patterns can be included on the reinforcing sheet metal to allow the passage of fluids to seep through different layers of the swellable sealing material for better and more uniform swelling. In various embodiments, the reinforcement layers included in the swellable sealing element may comprise stiff permeable sheets made out of composites can be used to replace the sheet metal. Embodiments of swell packers as disclosed herein may include more than one separate swellable sealing elements, for example two separate swellable sealing elements, positioned adjacent to one another longitudinally on a same conduit. In various embodiments, each of the separated swellable sealing elements may be separated from one another by a divider ring, for example a metal ring, the divider ring positioned around and encircling the conduit and between the oppositely facing end surfaces of the adjacent sealing elements.

As utilized throughout this disclosure, and unless otherwise described herein, the term "inner surface" refers to a surface or surfaces of a device or an entity that is/are closest in a radial direction to the longitudinal axis of the swell packer relative to other parts or portions of the device or entity, and the term "outer surface" refers to a surface or surfaces of a device or an entity that is/are farthest in a radial distance from the longitudinal axis of the swell packer relative to other parts or portions of the device or entity. Additional details regarding embodiments of reinforced swell packer are further illustrated and described with respect to FIGS. 2A-7. Various methods for operating a wellbore system utilizing the swell packer are illustrated and described with respect to FIG. 8. Various methods for manufacturing a reinforced swell packer are illustrated and described with respect to FIG. 9.

It would be understood that embodiments of this disclosure may be practiced without all of the specific details as described herein. Further, while the wellbores as illustrated and described in the figures of this disclosure are shown as comprising a vertically oriented borehole, embodiments of wellbores where the systems and methods as described in this disclosure may be deployed are not limited to wellbores having any particular orientation, and may include vertical, horizontal, and/or inclined wellbores, and combinations of these, including wellbore systems including one or more branches coupled to a main, a secondary, or other network(s) of a wellbore.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as limited to denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water, such as an ocean, or a body of fresh water.

Throughout this disclosure the terms "proximal" and "distal" are used to refer to a particular end portion of a device or element, such as a tubing or a borehole, which extend for some distance in a colinear or parallel direction relative to a longitudinal axis of the wellbore. The term "proximal" or "proximal end" refers to the end portion of the device or element that is closest to the wellhead of a wellbore when measured along the longitudinal axis of the wellbore and regardless of the actual distance from the wellhead. The term "distal" or "distal end" refers to the end portion of the device or element that is closest to the terminal end of a wellbore when measured along the longitudinal axis of the wellbore and regardless of the actual distance from the terminal end of the wellbore.

FIG. 1 is a block diagram depicting a wellbore system 100 configured to implement one or more swell packers, in accordance with various embodiments. As shown in FIG. 1, system 100 includes a wellbore 102 extending below surface 101 and into a formation 105. A platform 110 supports a derrick 112 over the area of the wellbore 102, the derrick configured with a hoist 114 to control the raising and lowering of various conduits, such as conduit 120, which may be coupled to one or more swell packers 122, 124, through an opening in platform 110 leading into wellbore 102. The opening in platform 110 may include a turntable or anchor collar 116, configured to stabilize the conduits and tooling being raised and lowered within the wellbore by hoist 114.

The space between platform 110 and surface 101 may include a casing 106, which extends below surface 101 and to some depth within the wellbore 102. A first swell packer 122 may be coupled to a conduit 120 that is suspended within the casing 106 of the wellbore 102. The swell packer 122 as shown in FIG. 1 is in an unactivated configuration, such that the swellable sealing element 123 of the swell packer has not yet been activated by an activation fluid, the activation fluid configured to cause the swellable sealing element 123 to expand, and thereby form a fluid seal between the swellable sealing element 123 and an inner surface 103 of casing 106. Once positioned in the desired location within the casing 106, swell packer 122/124 may be exposed to one or more activation fluids, which will cause the swellable sealing element 123 of the swell packer to swell, expanding the swellable sealing element 123 until one or more surfaces of the swellable sealing element come into sealing contact with the inner surface 103 of the casing 106. When in that configuration, the swell packer 122 is in an activated configuration, and provides a fluid seal between the upper cased annulus area 115 and the lower annulus area 117 of the wellbore 102.

In various embodiments, the activation fluid or fluids required to activate swell packer 122 may be present in the wellbore 102 due to infiltration of the fluid, for example from formation 105. In various embodiments, the activation fluid may be provided to the wellbore from above the surface 101, for example from fluid source 130, through one or more conduits 132 configured to provide the activating fluid(s) to the area of the wellbore 102 that are exposed to the swellable sealing element 123.

As further illustrated in FIG. 1, embodiments of system 100 may include a swell packer 124 including a swellable sealing element 127 that is positioned within the wellbore 102 at a location that is not enclosed by casing 106. In various embodiments, swell packer 124 is positioned downhole relative to the position of swell packer 122, and may be coupled to swell packer 122 by one or more additional conduit(s) 125. As such, when actuated to swell by exposure to one or more actuation fluids, the swellable sealing element 127 of swell packer 124 is configured to swell and expand as the swellable sealing element comes into contact with, and forms a seal with, an inner surface 107 of the open portion of the wellbore. In various embodiments, the activation fluid or fluids required to activate swell packer 124 may be present in the wellbore 102 due to infiltration of the fluid for example from formation 105, and/or provided to the wellbore from above the surface 101, as described above. When in the swelled configuration, the swell packer 124 is considered to be in an activated configuration, and provides a fluid seal between the lower annulus area 117 and the bottom annulus area 119 of the wellbore 102.

Embodiments of the swell packers 122 and/or swell packer 124 may be embodiments of the reinforced swell packers as further described below. For example, swell packer 122 and/or swell packer 124 may comprise a swellable sealing element that incorporated wound layers of a swellable elastomeric material, each layer of the swellable elastomeric material separated by a layer of reinforcement material, such as metal, which reinforces the swellable sealing element from physical damage and tearing, and may increase the pressure sealing capability of the actuated swellable packer once activated.

Although shown in FIG. 1 as comprising a strictly vertical wellbore 102, embodiments of system 100 may include swell packer that are located and activated to form seals in portions of wellbores that have other than vertical orientations, and may include the use of the reinforced swellable packers as described herein, and any equivalents thereof, in non-vertical wellbores having horizontal and/or other longitudinal directions relative to the vertical orientation shown in FIG. 1. In addition, as shown in FIG. 1 system 100 is illustrated as a terrestrial based system, but system 100 may include a wellbore system that extend through a body of water, such as a lake or an ocean, for some portion of the cased wellbore system.

Figure 2A:
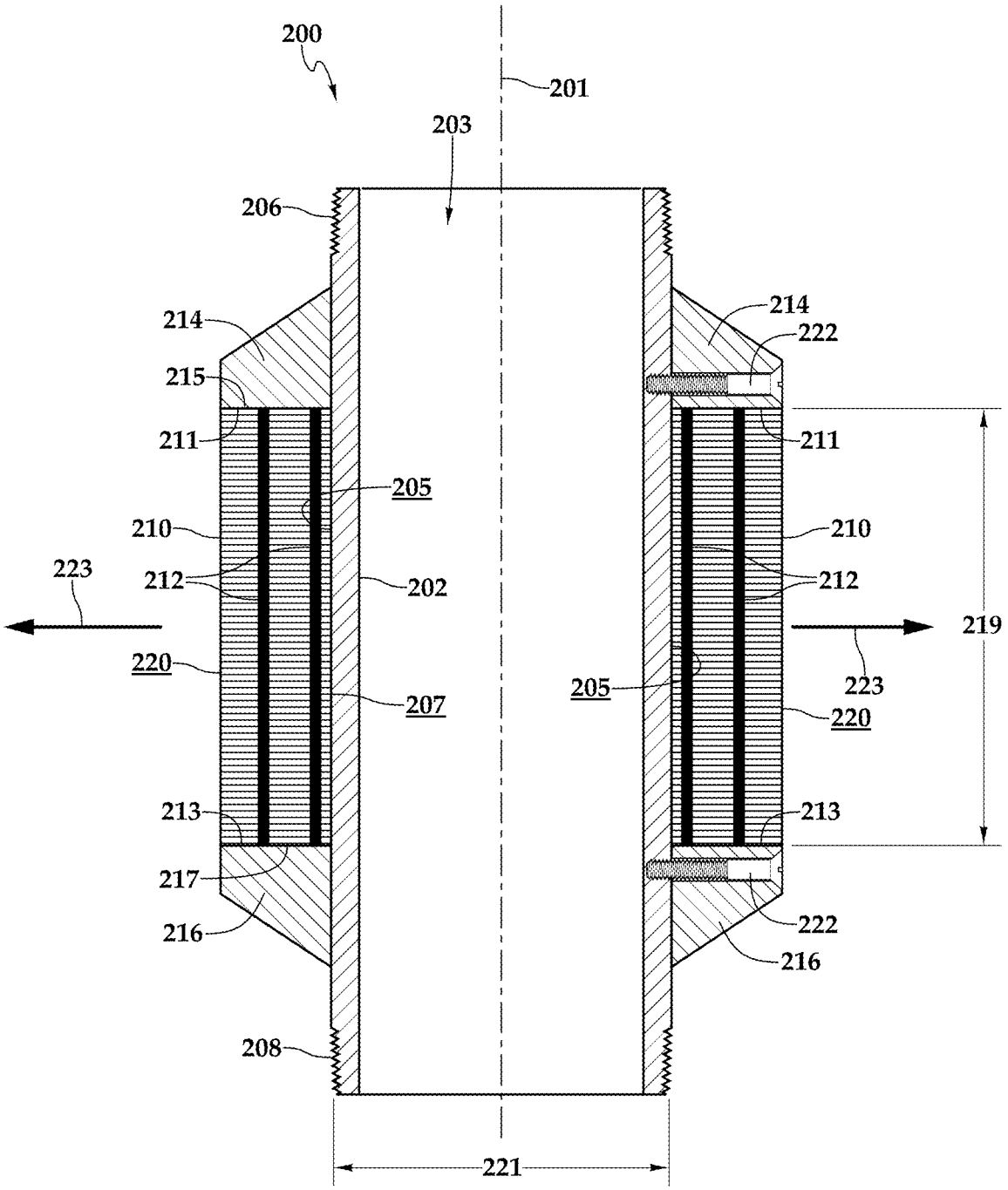
FIG. 2A is a cross-sectional diagram illustrating a swell packer, in accordance with various embodiments.

FIG. 2A is a cross-sectional diagram illustrating a swell packer 200, in accordance with various embodiments. As shown in FIG. 2A, swell packer 200 includes a swellable sealing element 210 that encircles a conduit 202 along some length of the longitudinal axis 201 of the swell packer. In various embodiments, conduit 202 comprises a tubular body having an upright cylindrical shape that encircles longitudinal axis 201, and includes interior space 203 extending through and encircled by the tubular body of the conduit. In various embodiments, conduit 202 is formed from a metal, such as but not limited to steel. In various embodiments, conduit 202 may have an outer diameter dimension 221 in a range from 0.8 to 50.8 centimeters (0.315 to 20 inches), inclusive.

A swellable sealing element 210 is positioned so that a bottom surface 207 of the swellable sealing element is in physical contact with an outer surface 205 of conduit 202 over a length dimension 219 extending longitudinally parallel to the longitudinal axis 201. A proximal end cap 214 encircles conduit 202, and is secured to conduit 202 at a position adjacent to the proximal end 206 of conduit 202. Proximal end cap 214 has a distally facing surface 215 that is in physical contact with a proximal end 211 of the swellable sealing element 210. A distal end cap 216 encircles conduit 202, and is secured to conduit 202 at a positioned adjacent to the distal end 208 of the conduit, which is spaced distally from the position of proximal end cap 214 along the outer surface 205 of the conduit. Distal end cap 216 has a proximally facing surface 217 that is in physical contact with a distal end 213 of the swellable sealing element 210.

Thus, as shown in FIG. 2A, the swellable sealing element 210 is positioned longitudinally around the outer surface 205 of conduit 202 and extends between the distally facing surface 215 of the proximal end cap 214 and the proximally facing surface 217 distal end cap 216 for a length dimension 219. The swellable sealing element including a bottom surface 207 in contact with outer surface 205 of conduit 202, a proximal end 211 in contact with a distally facing surface 215 of the proximal end cap 214, a distal end 213 in contact with a proximally facing surface of the distal end cap 216, and a top surface 220 that is not in contact with or constrained by the conduit or either of the end caps, allowing the swellable seal element 210 to expand outward radially away from the longitudinal axis 201 when activated, as indicated by arrows 223 and as further described below.

In various embodiments, proximal end cap 214 and distal end cap 216 are formed from a material comprising metal, such as but not limited to steel. Each of the proximal end cap 214 and the distal end cap 216 may be secured longitudinally in position around conduit 202 by a respective plurality of fasteners, such as pins, screws, rivets, and/or bolts, as illustratively represented in FIG. 2 as fasteners 222. In various embodiments, swellable sealing element 210 may be formed from one or more layers of a swellable elastomeric material, which, when exposed by a particular type of fluid, such as oil, water or a solution of water, is configured to swell and expand outward so that top surface 220 of the swellable sealing element 210 extends in a direction radially away from the conduit 202, as illustratively represented by arrows 223, while the bottom surface 207 remains in physical contact with the outer surface 205 of the conduit. In addition to the swellable elastomeric material, swellable sealing element 210 includes a layer of reinforcement sheet 212, also referred to as "reinforcement material," which is wound in a spiral manner so as to separate each of the layers of the swellable elastomeric material from one another. The combination of a layer of the swellable elastomeric material coupled with a layer of the reinforcement sheet 212 may include an initial layer formed from a combination of the swellable elastomeric material and the reinforcement material, which is wound around the outer surface 205 of the conduit, with one or more subsequent layers of the combination of the swellable elastomeric material coupled with a layer of the reinforcement sheet 212 wound on top of the initial layer, thereby forming a spiral configuration of layers extending from the first layer out to the top surface 220 of the swellable sealing element 210. In various embodiments, top surface 220 is formed at least partially, or in some embodiments completely, by a portion of reinforcement sheet 212, and may include a roughened surface configured to provide better gripping and anchoring capability when the swell packer is activated to form a seal within an open hole portion of a wellbore and when activated within another conduit such as a wellbore casing.

When activated by exposure to a particular fluid, such as a particular kind of oil or a particular type of water based solution or water alone, the swellable elastomeric material of the swellable sealing element 210 is configured to expand, and in the process, extend the top surface 220 in a radial direction away from the outer surface 205 of the conduit 202 while maintaining contact with the outer surface 205 of the conduit, and thereby forming a seal using the swellable sealing element between the conduit and a surface, such as a wall of a wellbore or an inner surface of a wellbore casing that is position adjacent to the top surface 220 as the swellable packer is activated. As the swellable packer is activated, the individual layers of the swellable elastomeric material included in the swellable sealing element 210 expand, and in the process, unwind to some extend by some degree of rotation around the longitudinal axis 201, including slippage between one side of the layer of swellable elastomeric material and a surface of the reinforcement sheet 212 that is adjacent to the layer of swellable elastomeric material.

By including the reinforcement layer embedded within the swellable elastomeric material of the swellable sealing element 210 as wound in a spiral fashion, the swellable packer element is configured to allow for the expansion of the swellable sealing element 210 to form a seal between the conduit 202 and another surface adjacent to the conduit when the swell packer 200 is positioned within a wellbore, wherein the addition of the reinforcement layer(s) embedded within the swellable sealing element 210 adds additional strength and tear resistance to the swellable sealing element provided by the addition of the reinforcement sheets 212 without inhibiting the ability of the swellable packer to expand from the inactivated configuration to an activated configuration, and thereby form a seal downhole once activated as described above.

The swellable material used to form the swellable portion of the swellable sealing element 210 is not limited to a particular type of material or compound. Swellable materials suitable for use in embodiments of the swell packer 200 may generally swell by up to about 130% or more of their original size at the surface as long as it is in contact with the fluid until reaching the casing internal diameter (ID) or open hole ID. Under downhole conditions, this swelling may be more (or less) dependent on the conditions presented. For example, the swelling may be about 10% or more at downhole conditions. In some embodiments, the swelling may be about 100% more under downhole conditions. However, the actual amount swelling of the swellable material may vary, for example, based on the concentration of, e.g., swellable polymer included in the swellable material, among other factors.

In some embodiments, a swellable material may include an elastomer. This may include a variety of elastomers such as natural, synthetic, thermoplastic, and thermosetting elastomers, which may be swellable. Some specific examples of swellable elastomers include, without limitation, natural rubber, acrylate butadiene rubber, polyacrylate rubber, isoprene rubber, chloroprene rubber, butyl rubber (IIR), brominated butyl rubber (BIIR), chlorinated butyl rubber (CIIR), chlorinated polyethylene rubber (CM/CPE), neoprene rubber (CR), styrene butadiene copolymer rubber (SBR), sulphonated polyethylene (CSM), ethylene acrylate rubber (EAM/AEM), epichlorohydrin ethylene oxide copolymer rubber (CO,ECO), ethylene-propylene rubber (EPM and EDPM), ethylene-propylene-diene terpolymer rubber (EPT), ethylene vinyl acetate copolymer, fluorosilicone rubbers (FVMQ), silicone rubbers (VMQ), poly 2,2,1-bicycloheptane (polynorbornene), and alkyl styrene. One example of a suitable swellable elastomer comprises a block copolymer of styrene-butadiene rubber. Examples of suitable elastomers that swell in contact with oil include, but are not limited to, nitrile rubber (NBR), hydrogenated nitrile rubber (HNBR, HNS), fluoro rubbers (FKM), perfluoro rubbers (FFKM), tetrafluoroethylene/propylene (TFE/P) and isobutylene maleic anhydride.

In some embodiments, the swellable material may be water swellable. Water-swellable elastomers may, for example, be derived from monomers which may include butadiene, chloroprene or isoprene copolymerized with monomers which produce polymers that are water swellable. Additional monomers may include open-chain conjugated dienes having from 5 to 8 carbon atoms, such as 2,3-dimethylbutadiene, 1,4-dimethylbutadiene, and piperylene. In some embodiments, the monomers may be copolymerized with a monomer which may render the swellable material water swellable, such as unsaturated polymerizable carboxylic acid (e.g., maleic acid, fumaric acid, etc.), sulfonic acids, and phosphoric acids. Polymerizable unsaturated molecules which contain more than one sulfonic, sulfate, phosphoric, or phosphate group may also be suitable for copolymerization with the monomers. Elastomeric copolymers containing monomers having water susceptible groups such as amides, amines and hydroxyl may also be used in some embodiments. Examples of such monomers may include, without limitation, furnaramide, acrylamide, and methacrylamide. Copolymers of any combination of the above monomers with monomers containing conjugated unsaturation may be obtained by copolymerizing the elastomeric engendering monomer with monomers that may be reacted to provide water swellability. Such polymers may include copolymers of diene monomers with acrylonitrile, acrylate esters and amides, methacrylate esters and amides, and maleic anhydride. These copolymers may be hydrolyzed to provide copolymers containing unsaturated chemical units and carboxylic acid units. Other reactions to provide suitable elastomers may include reactions on polymers such as hydrolysis of copolymers of vinyl acetate to give hydroxyl groups, ammonolysis of ester groups to give amide groups, and sulfonation to give elastomers which have sulfonic acid groups. In various embodiments, combinations of swellable elastomers may also be used.

The type of material used to form the reinforcement sheet 212 is not limited to any particular type of material, and may include any type of flexible material that may be formed into a flexible sheet, such as but not limited to a metal, such as copper, steel, aluminum, tin, or some metal alloy, such as a stainless steel. In various embodiments, the layer formed from reinforcement sheet 212 may be formed from a sheet of flexible material such as a plastic, for example but not limited to composites, wire mesh, etc. In various embodiments, the composites that would be used would be high tear resistant ones, which include but not limited to Aramide fibre, carbon fibre and glass fibre reinforced composites. The choice of matrix and fibre orientation would be to improve tear resistance of the final composite material.

Figure 2B:
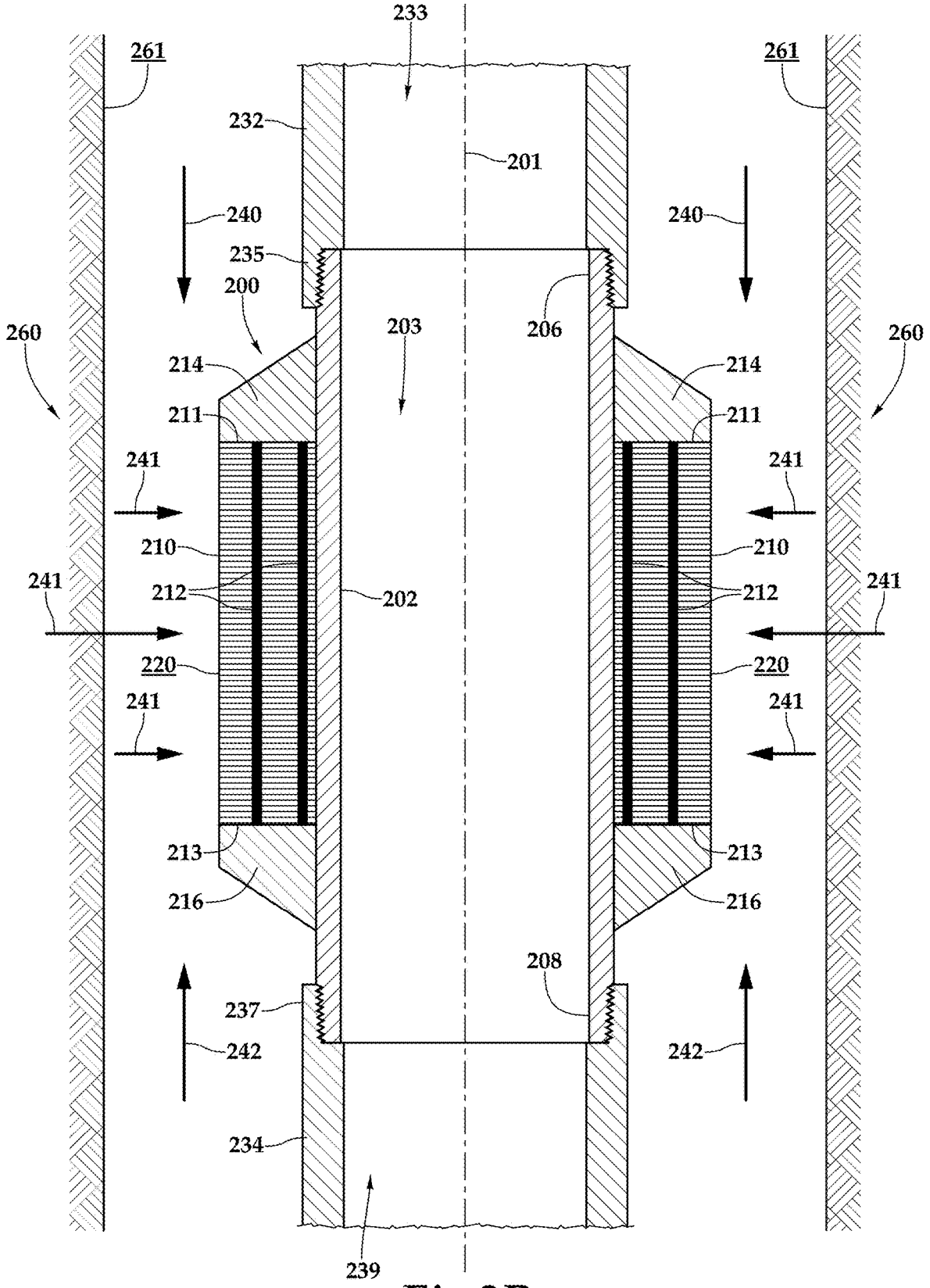
FIG. 2B illustrates a cross-sectional diagram of the swell packer of FIG. 2A, positioned downhole, in accordance with various embodiments.

FIG. 2B illustrates a cross sectional diagram of the swell packer 200 of FIG. 2A, positioned downhole, in accordance with various embodiments. As shown in FIG. 2B, the swell packer 200 is positioned at a location downhole in a wellbore extending through formation 260 and encircled by a wellbore surface 261. In various embodiments, wellbore surface 261 is the wall surface of an open portion of a wellbore that is exposed to formation 260. In various embodiments, wellbore surface 261 is an inner surface of another conduit, such as a wellbore casing (not shown in FIG. 2A, but see e.g., casing 106 in FIG. 1), into which the swell packer 200 has been positioned. As shown in FIG. 2B, the positioning of swell packer 200 at a location downhole includes a proximal end 206 of the swell packer being coupled to a distal end 235 of a first conduit 232 that extends proximally away from the swell packer, and is further coupled at a distal end 208 of the swell packer to a proximal end 237 of a second conduit 234 that extends in a distal direction from the swell packer. One or both of the first conduit 232 and the second conduit 234 may be coupled to the respective proximal end 206 and the distal end 208 of the swell packer 200 via threaded connections, as shown in FIG. 2B. One or both of the first conduit 232 and the second conduit 234 are configured to be physically coupled to additional structure, such as additional conduits, tubing, packers, and/or anchor assemblies (not shown in FIG. 2B, but see FIG. 1), which are configured to position and hold the swell packer 200 at a desired location within the wellbore prior to the activation of the swell packer.

Upon positioning of the swell packer 200 at the desired location within the wellbore, activation fluid(s) are provided, or may already be present at the location of the swell packer, and come into contact with the swellable sealing element 210 of the swell packer. The activation fluids may be provided from an area above the swellable sealing element 210, as represented by arrows 240, may be provided from the formation in the areas adjacent to the location of the swell packer, as illustratively represented by arrows 241, and/or may be provided from area(s) within the wellbore that are below the location of the swell packer, as illustratively represented by arrows 242. Regardless of the initial source of the activation fluids, the exposure of the swellable sealing element 210 of the swell packer 200 to these activation fluids will trigger the swelling of the material forming the swellable sealing element, and thereby cause the swellable sealing element to expand, moving the top surface 220 of the swellable sealing element radially outward and away from the conduit 202, to form a seal between the swellable packer and wellbore surface 261, as further illustrated and described below with respect to FIG. 2C.

Figure 2C:
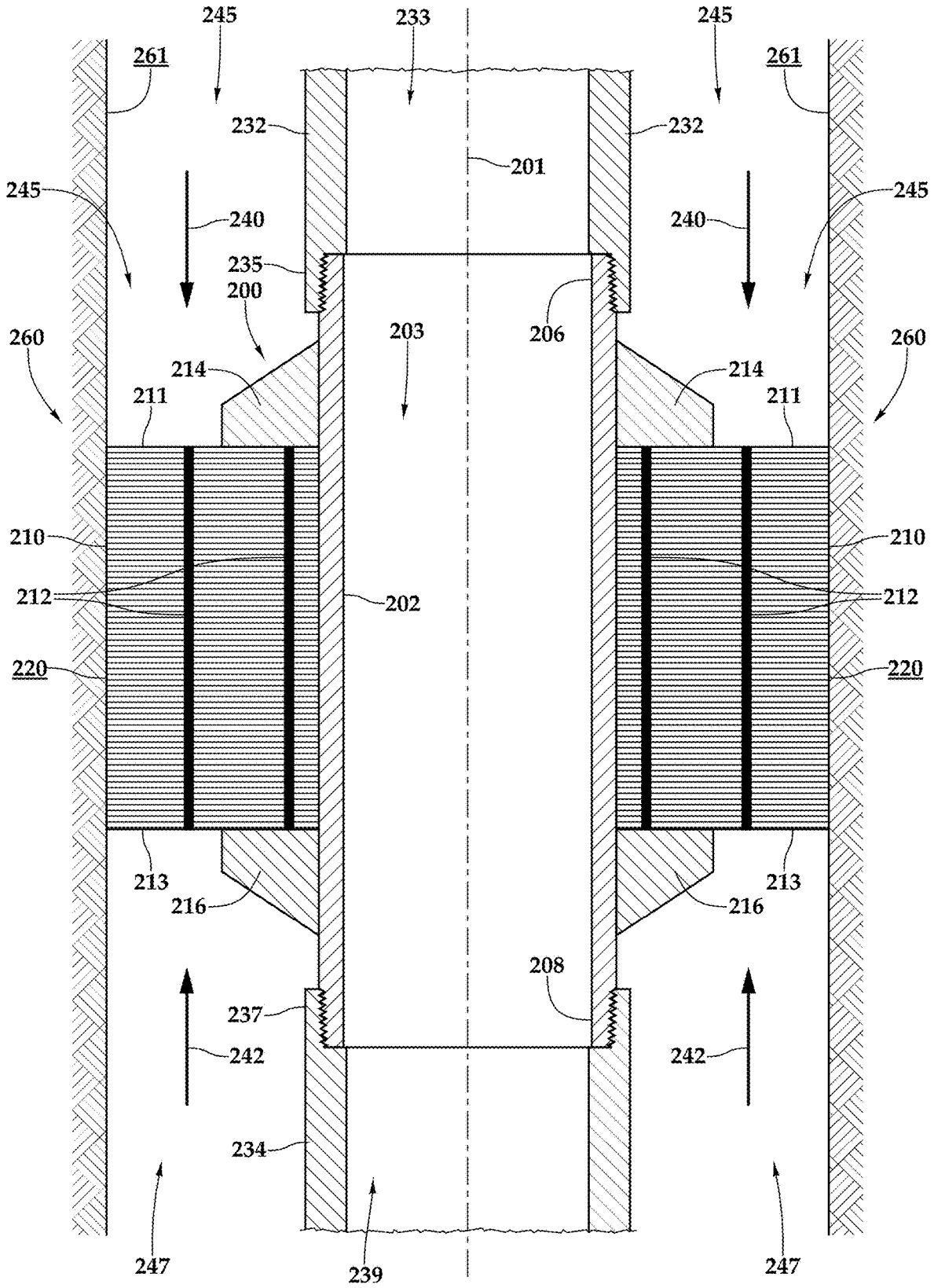
FIG. 2C illustrates a cross-sectional view of the swell packer of FIG. 2B, positioned downhole and activated to form a seal, in accordance with various embodiments.

FIG. 2C illustrates a cross-sectional view of the swell packer 200 of FIG. 2B, positioned downhole and activated to form a seal, in accordance with various embodiments. As shown in FIG. 2C, the sealing element 210 of swellable packer 200 has been exposed to one or more activation fluids, causing the swellable sealing element to swell and expand radially outward so that the top surface 220 of the swellable sealing element 210 is brought into physical contact with the inner surface 261 of the wellbore, while at least some portion of the bottom surface 207 of the swellable packer element remains in physical contact with the outer surface 205 of the conduit 202 along some longitudinal portion of the conduit. As such, at least the proximal end 211 of the swellable seal element 210, in conjunction with the proximal end cap 214 and the proximal end 206 of conduit 202, isolate annulus area 245 from the portion of the wellbore annulus indicated as annulus area 247, which is sealed at the proximal end of annulus area 247 by at least the distal end 213 of the swellable sealing element 210, distal end cap 216, and the distal portion of the conduit 202. When activated as shown in FIG. 2C, the swellable sealing element 210 provides a hydraulic seal between the annulus area 245 and annulus area 247. In various embodiments, when interior space 203 is configured as a through passageway, fluids may still be moved through the swellable packer using interior space 203, for example to or from fluid passageway 233 and fluid passageway 239, while the swell packer 200 blocks the flow of fluid outside of the swellable packer between annulus area 245 and annulus area 247. In various embodiments, the interior space 203 is configured as being blocked or closed off, and therefore and flows of fluids are blocked from passing through the swellable packer using interior space 203, while the swell packer also blocks the flow of fluid outside of the swellable packer between annulus area 245 and annulus area 247. As such, swell packer 200 may be configured to block all flows of fluid, including any flows of fluid passing outside of the swell packer.

Figure 2D:
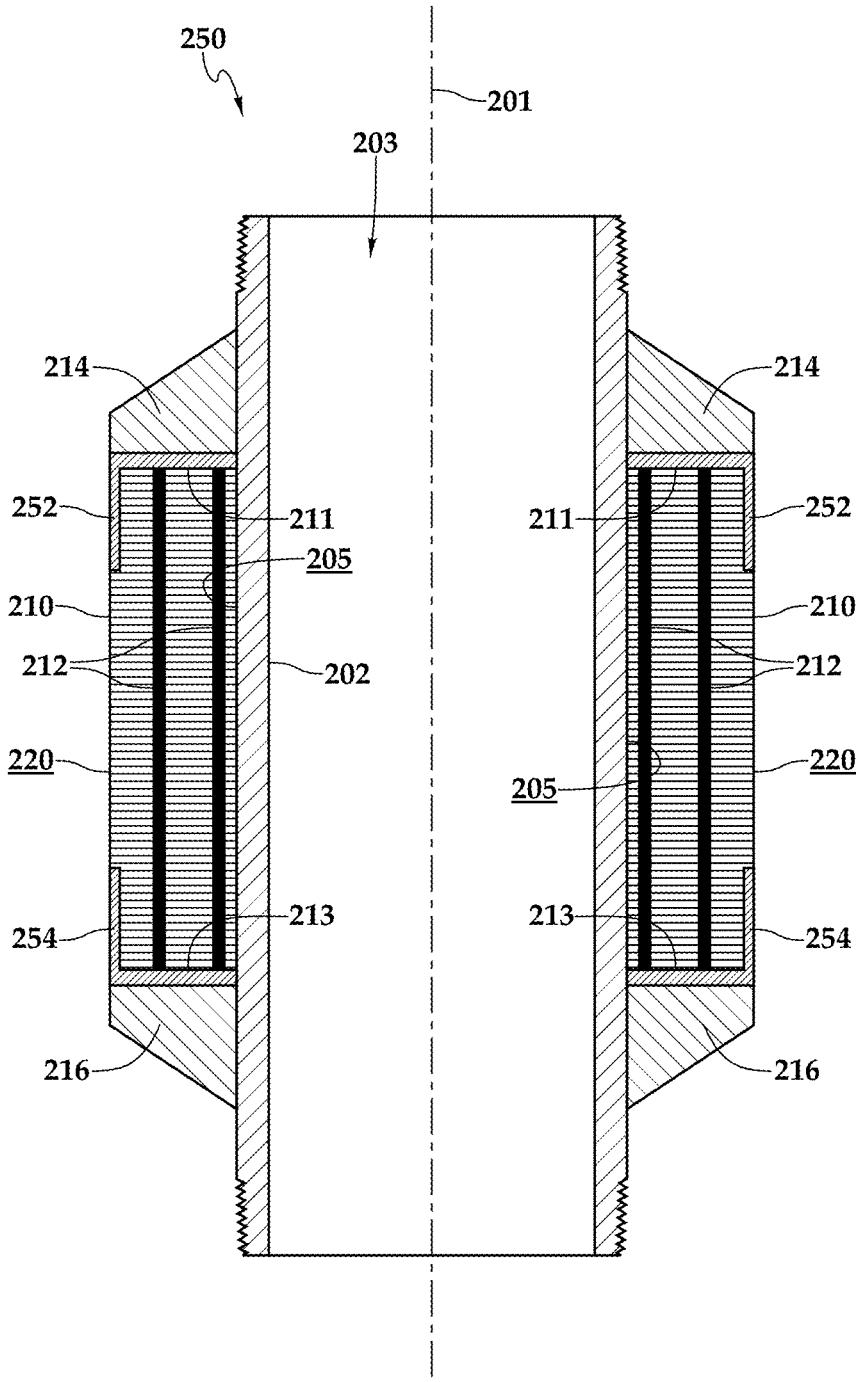
FIG. 2D illustrates a cross-sectional diagram of a swell packer, in accordance with various embodiments.

FIG. 2D illustrates a cross-sectional diagram of a swell packer 250, in accordance with various embodiments. Embodiments of swell packer 250 may include any of the features, and be configured to perform any of the functions described above and illustrated in FIGS. 2A-2C with respect to swell packer 200, with the differences as described below. For the sake of clarity, not every detail and/or every reference number as shown with respect to the swell packer 200 of FIGS. 2A-2C may be included in the illustration of swell packer 250 in FIG. 2D, but are considered to be included in the various embodiments of swell packer 250 regardless, with any variations and/or exceptions as described below for swell packer 250.

Figure 2E:
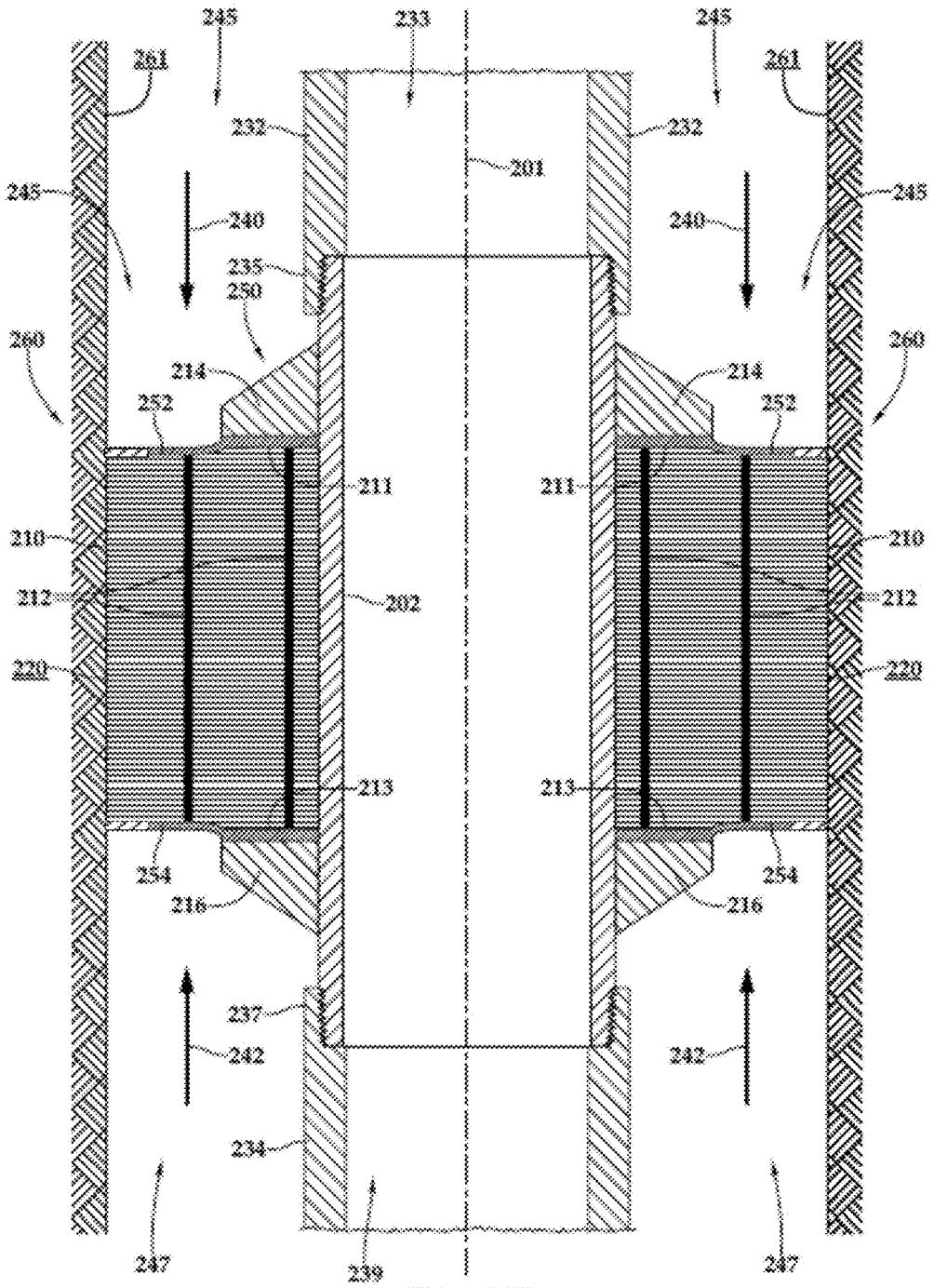
FIG. 2E illustrates a cross-sectional view of the swell packer of FIG. 2D, positioned downhole and activated to form a seal, in accordance with various embodiments.

As shown in FIG. 2D, swell packer 250 differs from swell packer 200 in that swell packer 250 includes the addition of one or more extrusion limitation collars. As shown in FIG. 2D, swell packer 250 includes a proximal extrusion limitation collar 252 positioned adjacent to the proximal end cap 214, and including "fingers" that extend distally for some distance longitudinal away from the proximal end cap and over the top surface 220 when the swellable sealing element 210 is in the unactuated configuration as shown in FIG. 2D. As further shown in FIG. 2D, swell packer 250 includes a distal extrusion limitation collar 254 positioned adjacent to the distal end cap 216, and including "fingers" that extend proximally for some distance longitudinal away from the distal end cap and over the top surface 220 when the swellable sealing element 210 is in the unactuated configuration as shown in FIG. 2D. In various embodiments, some portion of each of the extrusion limitation collars is anchored to or physically coupled with a respective one of the end caps of the swell packer, wherein the "fingers" of the extrusion limitation collars are configured to bend outward in a radial direction to maintain contact with a respective one of the proximal end 211 and the distal end 213 of the swellable sealing element 210 as the swellable sealing element 210 expands as part of an activation process. The "fingers" are thereby configured to inhibit the expansion of the swellable sealing element 210 over the outward facing sides of the respective end caps, and thereby increasing the sealing force being provide by the swellable sealing element between the conduit 202 and the inner surface of the adjacent wellbore to which the swellable sealing element is expanded to be in contact with. An example embodiment of an extrusion limitation collar is further described below and illustrated with respect to FIG. 7. FIG. 2E, as described below, illustrates the configuration of extrusion limitation collars 252 and 254 following activation of the swell packer 250.

FIG. 2E illustrates a cross-sectional view of the swell packer 250 of FIG. 2D, positioned downhole and activated to form a seal, in accordance with various embodiments. As shown in FIG. 2E, swell packer 250 has been activated, (for example as described above with respect to swell packer 200 and FIG. 2B), by exposure to an activation fluid, and thereby causing the swellable sealing element 210 to expand and come into contact with an inner surface 261 of a wellbore where the swell packer has been positioned, resulting in forming of a seal between annulus area 245 and annulus area 247. As further illustrated in FIG. 2E as a result of the activation of sealing element 210, the "fingers" of the proximal extrusion limitation collar 252 have been bent radially outward, and now extend between the distally facing surface 215 of proximal end cap 214 and the inner surface 261, thereby preventing the swellable sealing element 210 from extruding over the outer surface of the proximal end cap 214. In addition, and as further illustrated in FIG. 2E, as a result of the activation of sealing element 210, the "fingers" of the distal extrusion limitation collar 254 have been bent radially outward, and now extend between the proximally facing surface 217 of distal end cap 216 and the inner surface 261, thereby preventing the swellable sealing element 210 from extruding over the outer surface of the distal end cap 216. The positioning of the "fingers" of the extrusion limitation collars at each end of the swellable sealing element 210 provide further strengthening of the sealing element 210 with respect to the ability of the sealing element to resist physical damage, and may provide an additional level of pressure resistance to the seal, to thereby better withstand any pressure differentials that may occur between annulus area 245 and annulus area 247 following activation of the swell packer 250. The embodiments of swell packer 250 as described above and as illustrated in FIGS. 2D and 2E include one embodiment of extrusion limitation collars 252, 254. However, embodiments of swell packer 250 are not limited to the use of these particular collars, and may include any other type(s) of end ring and/or extrusion limitation devices that may exist in the market.

Figure 3A:
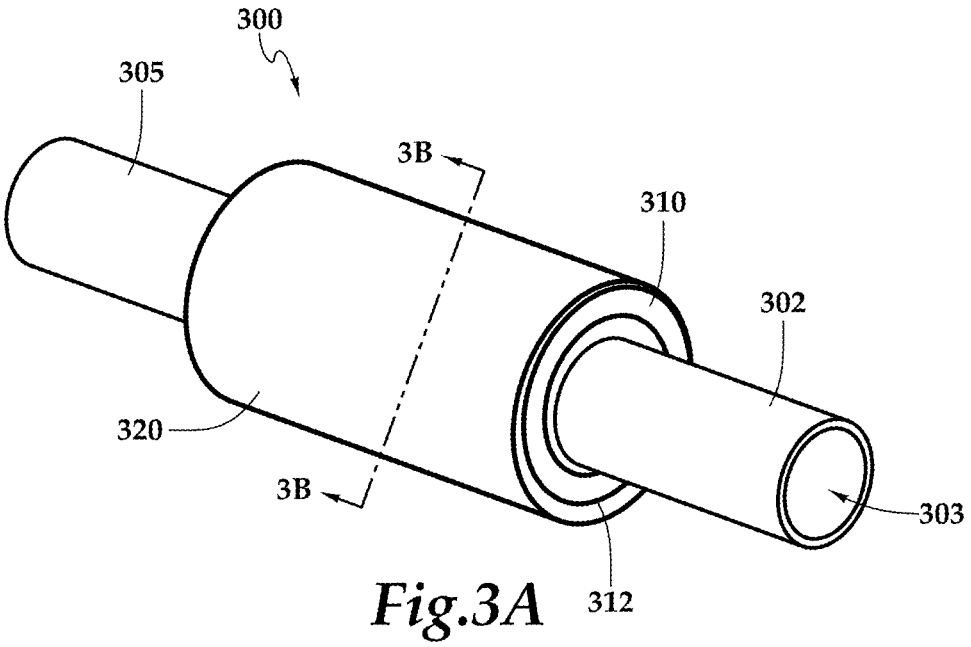
FIG. 3A illustrates a perspective view of a swell packer, in accordance with various embodiments.

FIG. 3A illustrates a perspective view of a swell packer 300, in accordance with various embodiments. As shown in FIG. 3A swell packer 300 includes a swellable sealing element 310 encircling a portion of a conduit 302, wherein the swellable sealing element comprises layers of a swellable elastomeric material that are separated by a layer of a reinforcement sheet 312. The layers of swellable elastomeric material and the intervening layer of reinforcement sheet 312 are wound around the conduit 302 in a spiral configuration, extending from an outer surface 305 of conduit 302 to form a cylindrical shape for the outer surface 320 encircling the conduit. A passageway 303 may extend through the center portion of the conduit 302, the passageway in various embodiments providing a through passageway for fluid to pass through the interior space provided by passageway 303. In various embodiments, some or all portions of the passageway 303 may be blocked off so as to not allow a flow of fluid to pass through the conduit 302.

Swell packer 300 as shown in FIG. 3A is illustrated without end caps, but may be configured to received end caps at each end of the sealing element 310. In a manner the same as or similar to the swell packers described above, swell packer 300 may be configured so that the swellable sealing element 310 is activated when exposed to a particular type of fluid, such as a particular type of oil or a particular type of water solution, or water itself, and expand outward in a radial direction away from the conduit 302 in order to form a seal between the conduit 302 and another surface positioned adjacent to outer surface 320 at the time of activation of the swell packer.

Figure 3B:
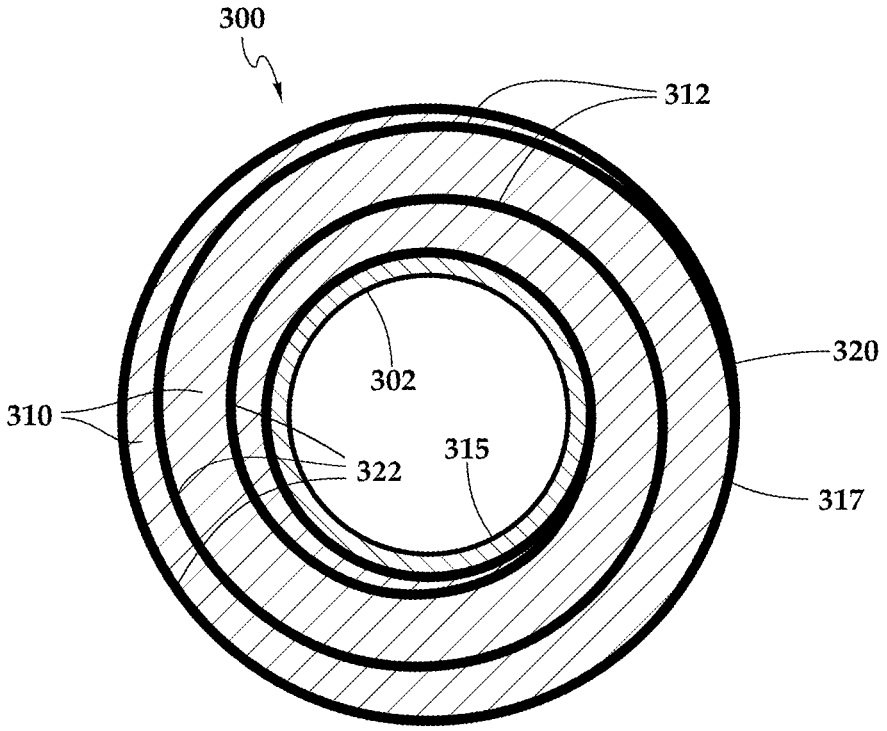
FIG. 3B is a cross-section view of the swell packer of FIG. 3A, taken at sectional line 3B-3B.

FIG. 3B is a cross-section view of swell packer 300 of FIG. 3A, taken at sectional line 3B-3B. As shown in FIG. 3B, layers of the swellable elastomeric material of sealing element 310 are wound around the conduit 302 in a spiral manner, each layer separated by a layer of the reinforcement sheet 312. The spiral winding originates at a position 315 representing a line extending longitudinally along the outer surface of the conduit 302, and extended in a spiral manner of layers wound one on top of another to outer point 317 and forming an outer surface 320 of the swell packer 300. Some embodiments consist of sheets of the swellable sealing material 310, such as a swellable rubber, which are reinforced with a metal sheet 312, having had a lubricant layer 322 applied on the other side to allow smooth unwrapping of the sheets during activation of the swell packer 300.

In various embodiment, the outer surface 320 may be completely formed of the swellable elastomeric material of the sealing element 310 with a rough surface finish. In other embodiments, the outer surface 320 may be completely formed from a layer of the reinforcement sheet 312. In various embodiments, a portion of the outer surface 320 may be formed from the swellable elastomeric material forming the sealing element 310 and a portion of the reinforcement sheet 312. In various embodiments, at least the portion of the reinforcement layer is formed as a mesh, with openings extending from a top surface to a bottom surface of the reinforcement sheet. When the outer surface 320 is formed from a mesh, the portions of the swellable elastomer material forming the sealing element 310 that are positioned at each of the openings in the mesh would provide a portion of the outer surface 320, wherein the portions of the reinforcement layer that surround each of the openings of the mesh would provide the balance of the outer surface 320.

Figure 4:
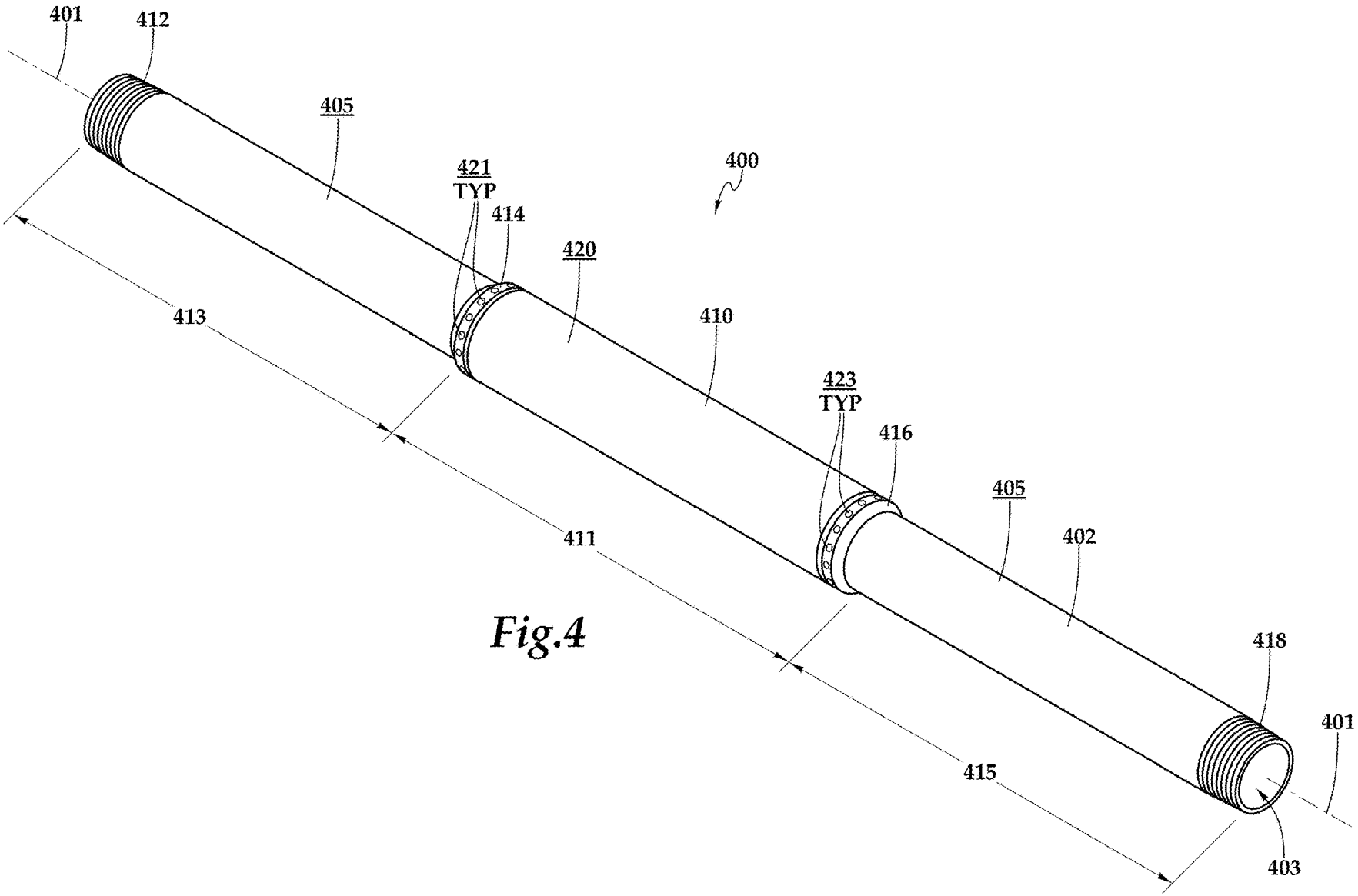
FIG. 4 illustrates a perspective view of a swell packer, in accordance with various embodiments.

FIG. 4 illustrates a perspective view of a swell packer 400, in accordance with various embodiments. Swell packer 400 may include any of the features described above, and be configured to perform any of the functions ascribed to swell packers 200, 250, and/or swell packer 300 as described above, with any differences as further described below. For example, the sealing element 410 of swell packer 400 may be configured to swell and expand, when exposed to the proper activation fluid(s), to form a seal between the conduit of the swell packer and another surface, such as the wall of a wellbore or an inner surface of a casing positioned adjacent to the swell packer when the swell packer is activated.

As shown in FIG. 4, swell packer 400 includes a sealing element 410 that encircles a conduit 402 along a length 411 of the longitudinal axis 401 of the conduit. In various embodiments, conduit 402 is formed as a cylindrical shaped tube having a rigid body, formed for example of a metal, which encircles a cylindrical shaped interior space 403. In various embodiments, interior space 403 may be hollow and extend through the conduit 402 to form a passageway, such as a flid passageway, which would allow a flow of fluid to pass through the interior space 403 of the conduit. In various embodiments, sealing element 410 is formed to be in physical contact with the outer surface 405 of the conduit, and is separated from the interior space 403 of the conduit by the body of the conduit.

In various embodiments, conduit 402 includes a proximal joint section 412 at the proximal end of the conduit configured to allow the proximal end of the conduit to be joined to another section of conduit, tubing, and/or a downhole tool (not shown in FIG. 4, but see e.g., conduit 232, FIG. 2B), which is configured to extend proximally from swell packer 400. Embodiments of swell packer 400 as shown in FIG. 4 may include distal joint section 418 at the distal end of the conduit 402, the distal joint configured to allow the distal end of the conduit to be joined to a different section of conduit, tubing and/or to a downhole tool (not shown in FIG. 4, but see e.g., conduit 234, FIG. 2B), which extends in a distal direction from swell packer 400.

Referring to FIG. 4, the sealing element 410 of swell packer 400 may be held longitudinally in position relative to conduit 402 at the proximal end of the sealing element by end cap 414, and may further be held longitudinally in position relative to conduit 402 at the distal end of the sealing element by distal end cap 416. A plurality of fasteners 421, in some examples threaded fasteners, may be used to secure the proximal end cap 414 in position longitudinally relative to conduit 402. In a similar or same manner, a plurality of fasteners 423 may be used to secure the distal end cap 416 in position longitudinally relative to conduit 402. Sealing element 410 is thereby secured longitudinally in position relative to conduit 402 by proximal end cap 414 and distal end cap 416.

In various embodiments, a portion of conduit 402 that includes proximal joint section 412 extends proximally from proximal end cap 414 for a length 413 in a range from 100 to 500 centimeters, (39.4 to 196.8 inches), inclusive, and a portion of conduit 402 that includes distal joint section 418 extends distally from distal end cap 416 for a length 415 in a range from 100 to 500 centimeters (39.4 to 196.8 inches), inclusive. Sealing element 410, including proximal end cap 414 and distal end cap 416, may extend longitudinally along conduit 402 for a length 411 in a range from 30 to 1000 centimeters (11.8 to 393.7 inches), inclusive. The overall length of the swell packer 400 is a combined length of the 413, 411, and 415 dimensions. In various embodiments, length 413 and 415 are equal lengths, and in various embodiments, lengths 413 and 415 represent different lengths of conduit 402. In various embodiments, sealing element 410 is centered between the proximal portion of the conduit and the distal portion of the conduit when length dimensions 413 is equal to length dimension 415. In various embodiments, the actual value(s) for one or more of the dimensions described in this paragraph are determined based on the specific needs of the customer and/or the application to which the swellable packer is being applied to.

In various embodiments, sealing element 410 comprises layers of swellable elastomeric material, each of the layers of swellable elastomeric material separated from one another by a layer of reinforcement material, and having the layers of swellable elastomeric material and reinforcement layer wound around the outer surface 405 of the conduit 402 in a spiral matter to the outer surface 420. In various embodiments, outer surface 420 of sealing element 410 may be composed entirely of exposed portions of the swellable elastomeric material forming the swellable sealing element 410. In various embodiments, outer surface 420 of sealing element 410 may be composed of partially exposed portions of the elastomeric material forming the swellable material of the sealing element, the partial exposure resulting from the continuation of the mesh material or the solid sheet material used to form the reinforcement layer wound within and embedded in the swellable elastomeric material onto to at least a portion of the outer surface 420 of the swell packer prior to the activation of the swell packer.

Figure 5:
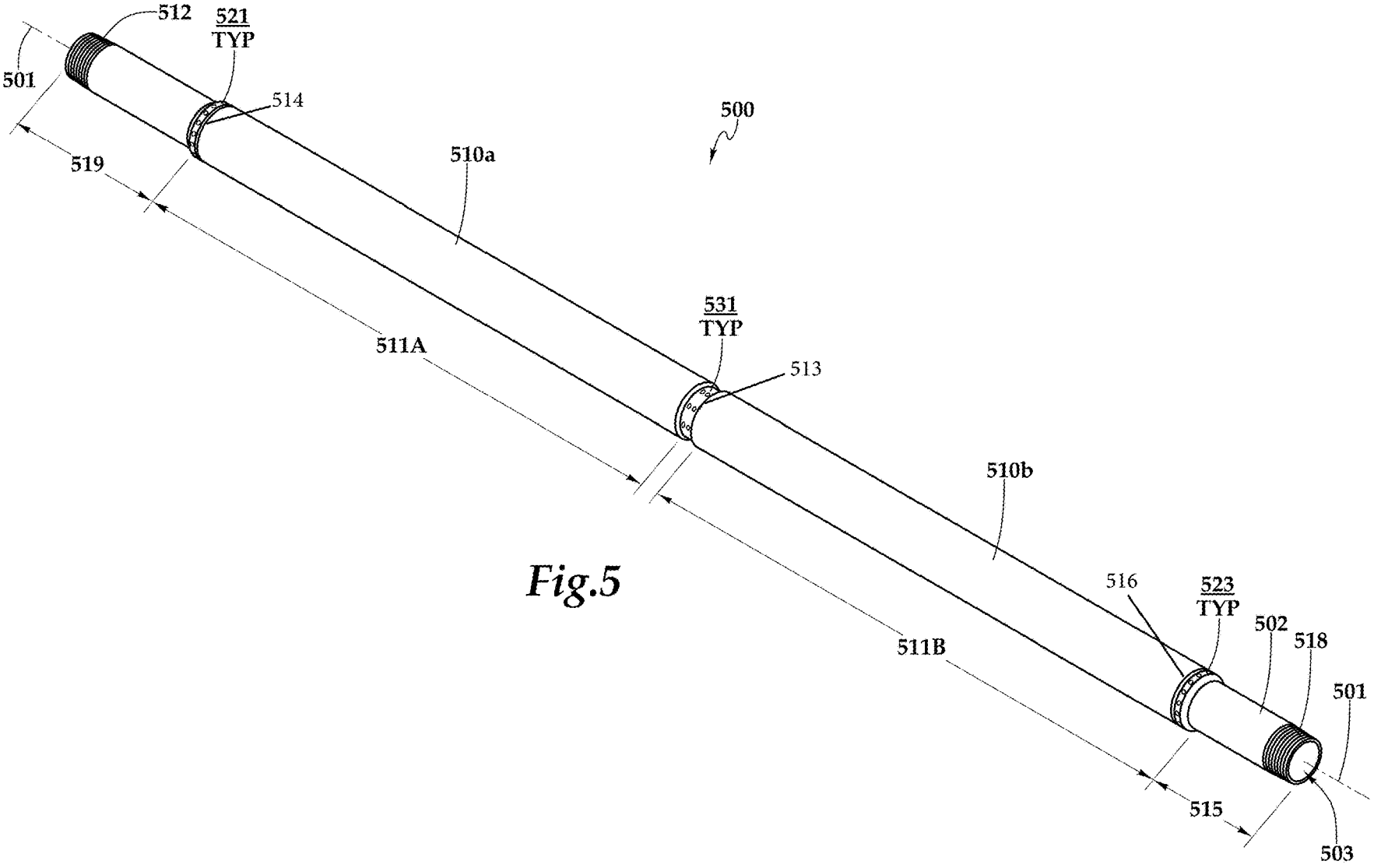
FIG. 5 illustrates a perspective view of a swell packer, in accordance with various embodiments.

FIG. 5 illustrates a perspective view of a swell packer 500, in accordance with various embodiments. Swell packer 500 may include any of the features and be configured to perform any of the functions ascribed to swell packer 200, swell packer 250, and/or swell packer 300 as described above, with any differences as further described below. For example, the sealing elements 510A and 510B of swell packer 500 may be configured to swell and expand, when exposed to the proper activation fluid(s), to form a seal between the conduit of the swell packer and another surface, such as the wall of a wellbore or an inner surface of a casing positioned adjacent to the swell packer when the swell packer is activated.

As shown in FIG. 5, swell packer 500 includes a first sealing element 510A that encircles a conduit 502 along a length 511A of the longitudinal axis 501 of the conduit 502, and a second sealing element 510B that also encircles conduit 502 along a length 511B of the longitudinal axis of the conduit. In various embodiments, conduit 502 is formed as a cylindrical shaped tube having a rigid body, formed from example of a metal, which encircles a cylindrical shaped interior space 503. In various embodiments, interior space 503 may be hollow and extend through the conduit 502 to form a passageway, such as a fluid passageway, which would allow a flow of fluid to pass through the interior space 503 of the conduit. In various embodiments, each of the swellable sealing elements 510A and 510B is formed to be in physical contact with the outer surface 505 of the conduit, and is separated from the interior space 503 of the conduit by the body of the conduit.

In various embodiments, conduit 502 includes a proximal joint section 512 at the proximal end of the conduit configured to allow the proximal end of the conduit to be joined to another section of conduit, tiding, or a downhole tool (not shown in FIG. 5, but see e.g., first conduit 232, FIG. 2B), which extends proximally from swell packer 500, and includes distal joint 518 at the distal end of the conduit configured to allow the distal end of the conduit to be joined to a different section of conduit, tubing or to a downhole tool (not shown in FIG. 5, but see e.g., conduit 234, FIG. 2B), which extends in a distal direction from swell packer 500.

The sealing element 510A of swell packer 500 may be held longitudinally in position at the proximal end of the sealing element by end cap 514, and may further be held longitudinally in position relative to conduit 502 at the distal end of the sealing element by center ring 513. A plurality of fasteners 521, in some examples threaded fasteners, may be used to secure the proximal end cap 514 in position longitudinally relative to conduit 502, while a plurality of fasteners 531, in some embodiments threaded fasteners, may be used to hold center ring 513 in position longitudinally along the outer surface of conduit 502.

The sealing element 510B of swell packer 500 may be held longitudinally in position at the distal end of the sealing element by end cap 516, and may further be held longitudinally in position relative to conduit 502 at the proximal end of the sealing element by center ring 513. A plurality of fasteners 523, in some examples threaded fasteners, may be used to secure the distal end cap 516 in position longitudinally relative to conduit 502. Sealing elements 510A and 510B may thereby be secured longitudinally in position relative to conduit 502 by proximal end cap 514, center ring 513, and distal end cap 516.

In various embodiments a portion of conduit 502 that includes proximal joint section 512 extends proximally from proximal end cap 514 for a length 519 in a range from 100 to 500 centimeters, (39.4 to 196.5 inches), inclusive, and a portion of conduit 502 that includes distal joint 518 extends distally from distal end cap 516 for a length 515 in a range from 100 to 500 centimeters (39.4 to 196.5 inches), inclusive. Sealing element 510A, including proximal end cap 514, may extend longitudinally along conduit 502 for a length 511A in a range from 30 to 300 centimeters (11.8 to 118.1 inches), inclusive. Sealing element 510B, distal end cap 516, may extend longitudinally along conduit 502 for a length 511B in a range from 30 to 300 centimeters (11.8 to 118.1 inches), inclusive. In various embodiments, the length dimension 511A for sealing element 510A is equal to the length dimension 511B for sealing element 510B. In various embodiments, the length dimension 511A for sealing element 510A is a different length relative to the length dimension 511B for sealing element 510B. Further, in various embodiments the length dimension 519 for the proximal portion of the conduit 502 extending proximally of sealing element 510A may be the same length or a different length compared to the length dimension 515 for the distal portion of the conduit extending distally from sealing element 510B.

The overall length of the swell packer 500 is a combined length of the 519, 511A, 511B, and 515 dimensions. In various embodiments, sealing elements 510A and 510B are centered between the proximal portion of the conduit and the distal portion of the conduit when length dimensions 519 is equal to length dimension 515.

In various embodiments, sealing element 510A comprises layers of swellable elastomeric material, each of the layers of swellable elastomeric material separated from one another by a layer of reinforcement material, and having the layers of swellable elastomeric material and reinforcement layer wound around the outer surface 505 of the conduit 502 in a spiral manner to the outer surface 520A. In various embodiments, outer surface 520A of sealing element 510A may be composed entirely of exposed portions of the swellable elastomeric material forming the swellable sealing element 510A. In various embodiments, outer surface 520A of sealing element 510A may be composed of partially exposed portions of the elastomeric material forming the swellable material of the sealing element, the partial exposure resulting from the continuation of the mesh material or the solid sheet material used to form the reinforcement layer wound within and embedded in the swellable elastomeric material onto to at least a portion of the outer surface 520A of the swell packer prior to the activation of the swell packer.

In various embodiments, sealing element 510B comprises layers of swellable elastomeric material, each of the layers of swellable elastomeric material separated from one another by a layer of reinforcement material, and having the layers of swellable elastomeric material and reinforcement layer wound around the outer surface 505 of the conduit 502 in a spiral manner to the outer surface 520B. In various embodiments, outer surface 520B of sealing element 510B may be composed entirely of exposed portions of the swellable elastomeric material forming the swellable sealing element 510B. In various embodiments, outer surface 520B of sealing element 510B may be composed of partially exposed portions of the elastomeric material forming the swellable material of the sealing element, the partial exposure resulting from the continuation of the mesh material or the solid sheet material used to form the reinforcement layer wound within and embedded in the swellable elastomeric material onto to at least a portion of the outer surface 520B of the swell packer prior to the activation of the swell packer. Although shown in FIG. 5 as having two reinforced and swellable sealing element, embodiments of swell packer 500 are not limited to having only two sealing elements. Various embodiments of swell packer 500 may include additional swellable sealing elements, such as but not limited to three or more swellable sealing elements, wherein the additional swellable sealing elements are each positioned along different locations longitudinally along conduit 502, and may be separated for one another by an additional number of divider rings. The addition of swellable sealing elements in excess of two swellable sealing element may accommodate the capability to provide a swell packer having an overall longer longitudinal dimension, in some embodiment up to 10 meters (32.8 feet), inclusive, in length.

Figure 6A:
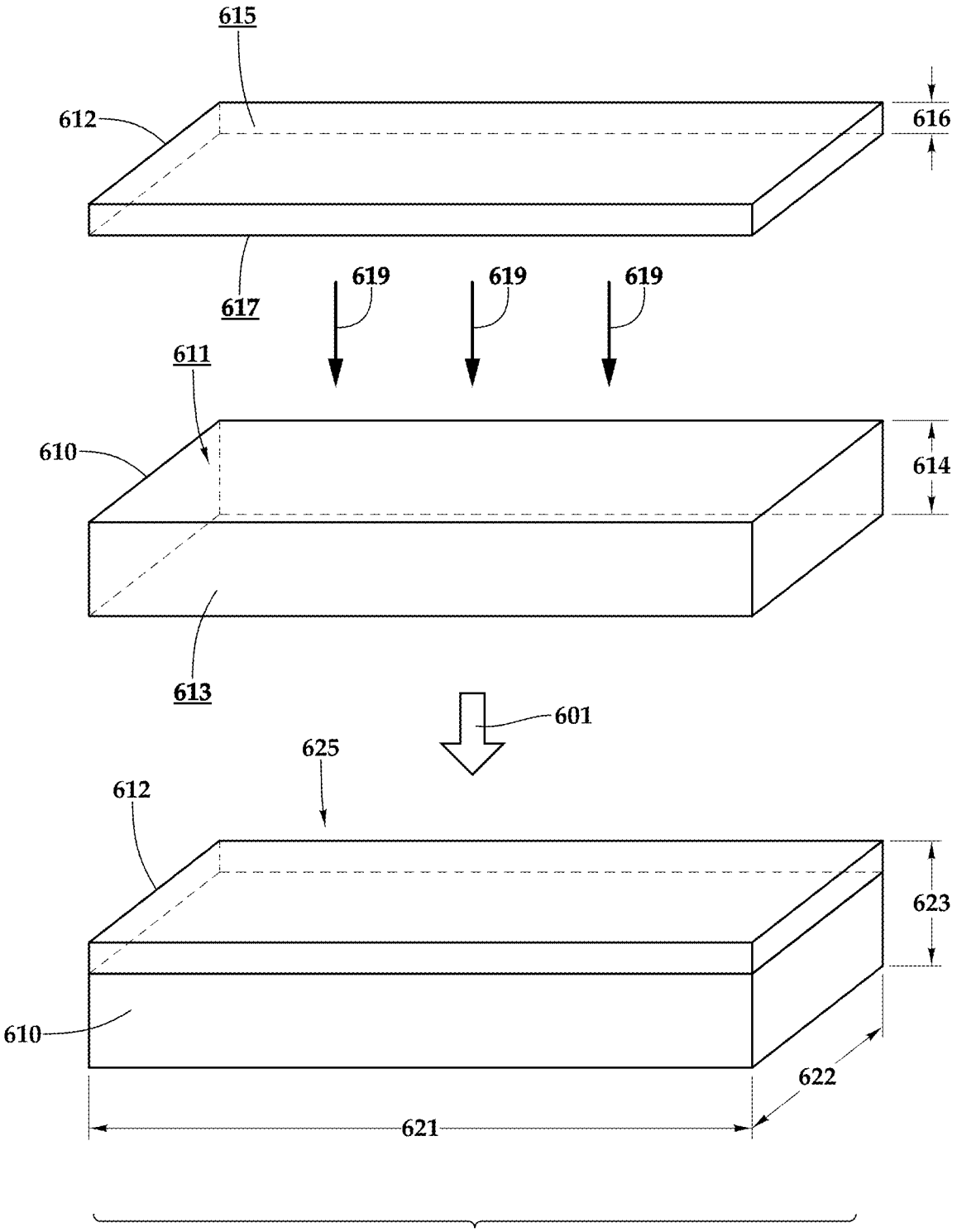
FIGS. 6A-6C illustrate simplified diagrams illustrative of manufacturing processes used to make a swell packer, in accordance with various embodiments.
Figure 6B:
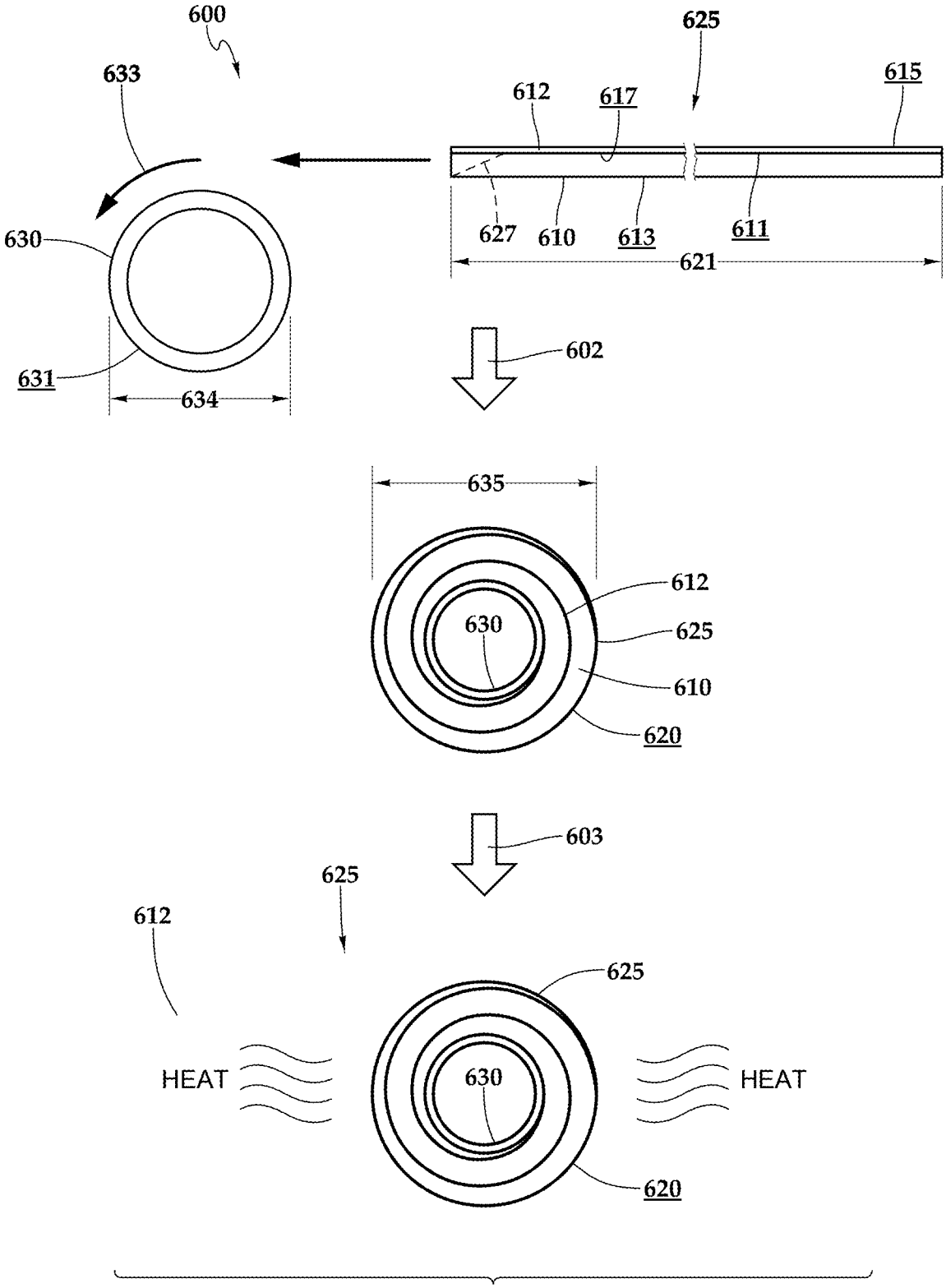
Figure 6C:
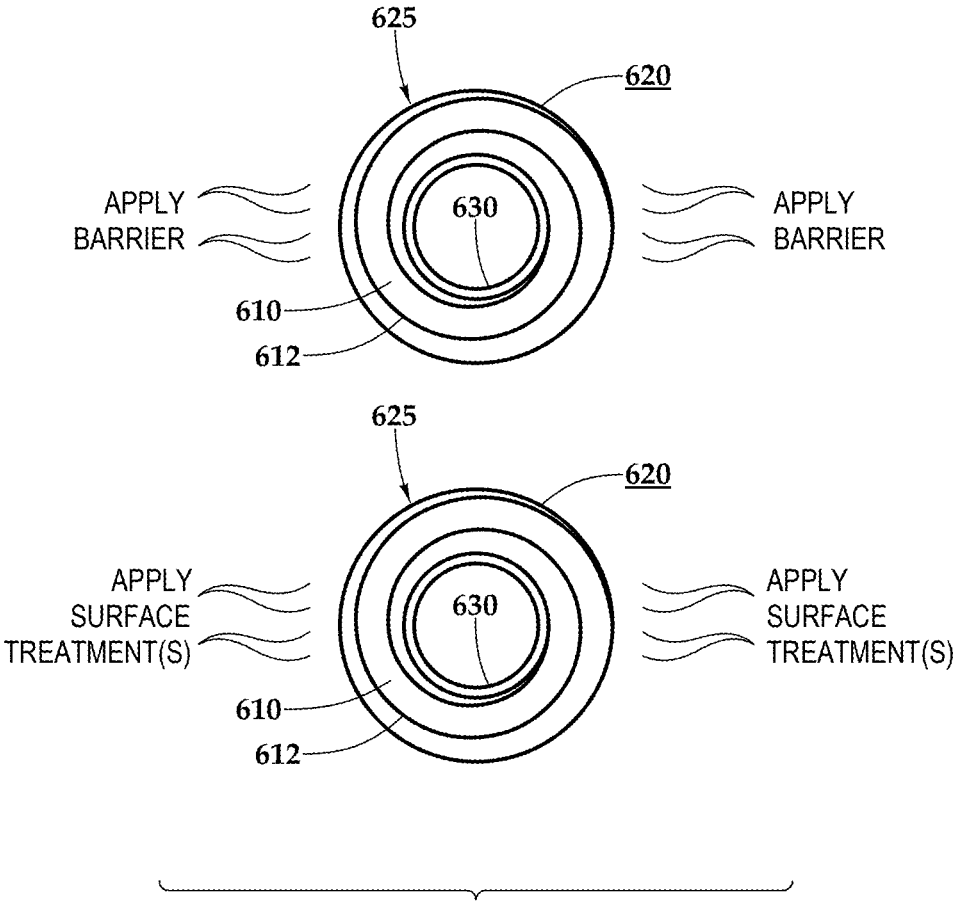

FIGS. 6A-6C illustrates simplified diagrams illustrative of manufacturing processes 600 used to make a swell packer, in accordance with various embodiments.

As shown in the upper portion of FIG. 6A, a first sheet 610 comprising swellable elastomeric material is provided, the first sheet 610 having a three-dimensional rectangular shape, a flat planar top surface 611, and a flat planar bottom surface 613 positioned parallel to the top surface 611 and separated from the top surface 611 by a thickness dimension 614 of the sheet. A second sheet 612 is also provided, the second sheet 612 comprising a sheet of flexible material, such as metal, the second sheet 612 having a three-dimensional rectangular shape, a flat planar top surface 615, and a flat planar bottom surface 617 positioned parallel to the top surface 615 and separated from the top surface 615 by a thickness dimension 616 of the second sheet. In various embodiments a width and length dimension of the first sheet 610 are the same dimensionally as a width and length dimension of the second sheet 612.

As illustratively represented by arrows 619, the bottom surface 617 of second sheet 612 is positioned to be brought into contact with the top surface 611 of the first sheet 610, to form the combined two-layer structure 625 as illustrated in the lower portion of FIG. 6A. In various embodiments, the two layers of the two-layer structure 625 may be joined together using an adhesive layer that is applied to one or both of the bottom surface 617 and/or the top surface 611 prior to joining the two layers together. In various embodiments, the first sheet 610 and the second sheet 612 may be fused together using a heat and/or a pressure treatment process after physically joining the two layers together. In various embodiments, after joining the two layers together, a trimming process may be used to trim the combined two layer structure 625 to a predetermined length dimension 621, and predetermined width dimension 622, and/or a predetermined thickness dimension 623. These predetermined dimensions may be calculated based on a variety of factors, including the outside diameter of the conduit that the two layer structure 625 is to be wound onto, the overall outside dimension of the swell packer after winding the two layer structure 625 onto the conduit, the desired level of swelling required upon activation of the swell packer, and the overall pressure sealing requirements that are needed to be provide by the activated swell packer.

The upper portion of FIG. 6B illustrates the two-layer structure 625 being prepared for winding, as illustrated by curved arrow 633, onto the outer surface 631 of a conduit 630. In various embodiments, a ramp 627 may be formed into the two-layer structure 625 at the end of the two layer structure that will first contact the conduit 630 in order to provide an angled edge for the initial contact portion of the two layer structure with the outer surface 631 of the conduit. The conduit 630 may include a predetermined outer diameter 634 calculated based on various factors, such as the number of layers and the thickness of the two-layer structure 625 that is being wound onto the conduit, and the overall swell characteristics of the swell packer once completed, along with the desired pressure sealing characteristics of the activated swell packer.

The middle portion of FIG. 6B illustrated an end view of a swell packer having the two-layer structure 625 wound around conduit 630 in multiple overlapping layers, with the second sheet 612 comprising the reinforcement layer separating each of the layers of the first sheet 610 of swellable elastomeric material from one another. The final outer surface 620 of the wound swell packer may be made to have an outside diameter dimension 635 that is calculated based on various factors, including the diameter of the wellbore or inside diameter of a casing or conduit where the swell packer is intended to be deployed to form a seal between the conduit 630 and the wellbore, casing or other conduit. In various embodiments, the diameter dimension 635 may be in a range from 2.4 cm to 70.1 cm (0.95 inches to 27.6 inches), inclusive.

When formed as illustrated in the middle portion of FIG. 6B, there may be voids in various portions the windings, and/or a lack of a complete seal material between the outer surface 620 and the adjacent layers of the elastomeric material of first sheet 610 that were not originally boned to the reinforcement sheet to allow for rotational movement of the layers of the two layer structure as the side of the second sheet 612.

As shown in the lower portion of FIG. 6B, the now wound swell packer may be further treated, for example using heat treatment, pressure treatment, or a combination of both heat and pressure, to vulcanize the elastomeric material of the first sheet 610 of swellable material so that the material fills in any voids present between the outer surface 631 of the conduit and the outer surface 620 of the wound swell packer.

As shown in the upper portion of FIG. 6C, the vulcanized swell packer of the lower portion of FIG. 6B may be further processed to add, for example using a spray on technique, a barrier layer to the outer surface 620 of the swell packer. In various embodiments, the barrier layer consists of a material that will delay the exposure of an activation fluid (such as oil or a water solution, or water itself) to the swellable elastomeric material of the first sheet 610 of the swell packer when the activation fluid comes into contact with the barrier layer, but wherein after some exposure time, the barrier layer is for example dissolved, thereby by allowing the elastomeric material of first sheet 610 to be exposed to the activation fluid after some period of time delay. In various embodiments, this time delay is desirable to allow for example positioning of the swell packer into a final and desired position with a wellbore despite being exposed to the activation fluid at some point in time prior to the final positioning of the swell packer.

In various embodiments, as shown in the bottom portion of FIG. 6C, one or more surface treatments may be applied to the outer surface 620 to enhance the anchoring and/or gripping capability of the outer surface once the outer surface has been brought into contact with another surface adjacent to the swell packer, such as the inner wall of a wellbore or a casing, following activation of the swell packer. Surface treatments may include but are not limited to knurling the metal sheet for rougher surface finish before applying of the delay barrier, grinding the outer surface of the packer to rough surface finish, etc.

Figure 6D:
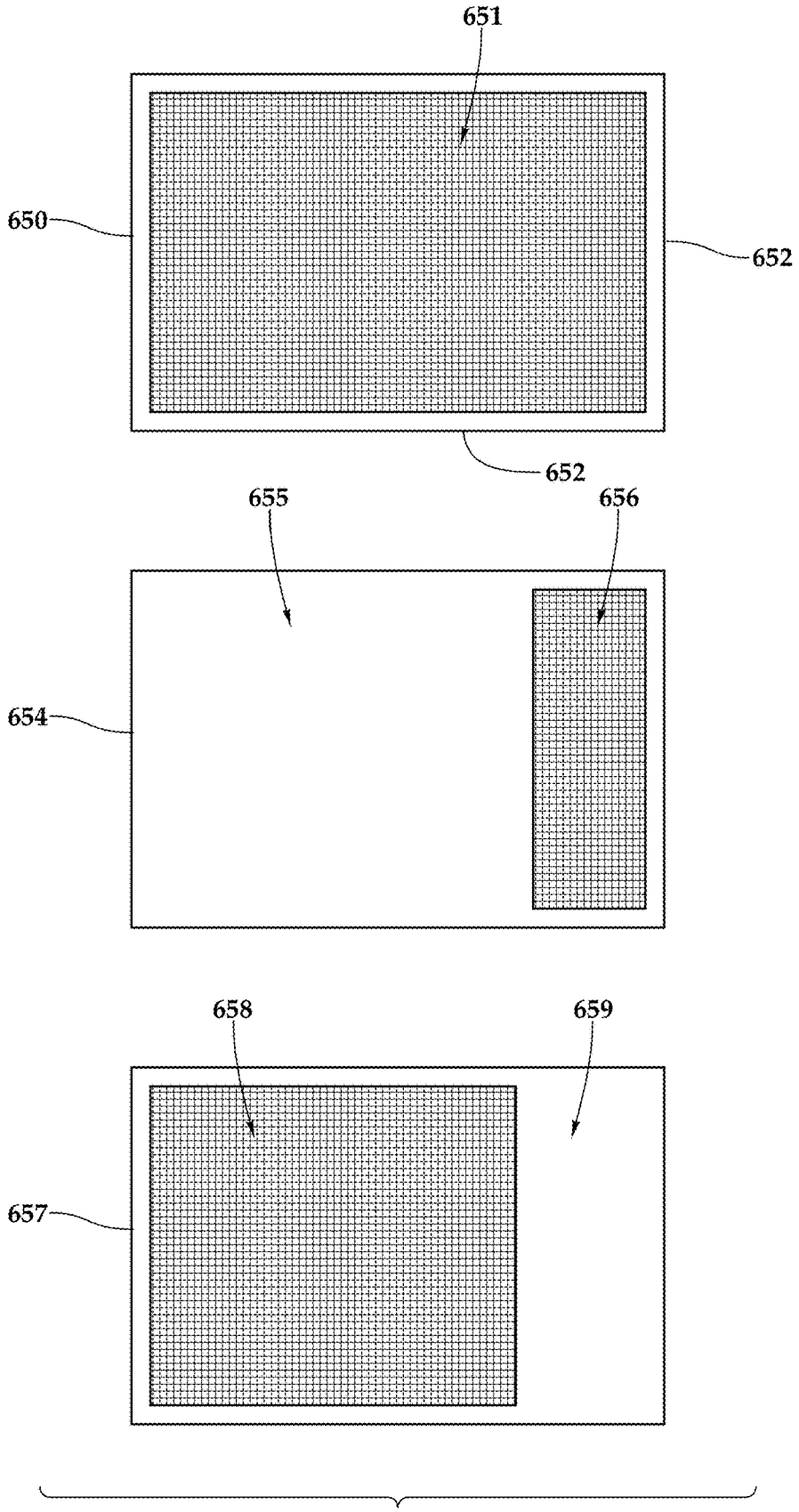
FIG. 6D illustrates variations in the reinforcement sheet used to reinforce a swellable sealing element, in accordance with various embodiments.

FIG. 6D illustrates top views of variations in the reinforcement sheets used to reinforce a swellable sealing element, in accordance with various embodiments. As shown in the upper portion of FIG. 6D, reinforcement sheet 650 includes a mesh structure 651 that extends over a majority, or in some embodiments the entirety of the reinforcement sheet. Mesh structure 651 includes a plurality of openings that extend through the reinforcement sheet, and may be arranged in any pattern, including rows and columns of openings. In addition, the shape of the openings included in the mesh structure 651 is not limited to having a particular shape, and may be round, square, rectangular, elliptical, triangular, elongated slots, or any closed polygonal shape. In various embodiments, one or more of the opening has a different shape and/or different dimensions relative to one or more other openings included in the mesh structure. Embodiments of reinforcement sheet 650 may include a boarder 652 along one or more sides of the sheet that are devoid of openings for some distance from the adjacent edge of the sheet. In some embodiments, the mesh pattern of openings extends all the way to one, some, or all of edges of the sheet.

In various embodiments, when reinforcement sheet 650 is wound as a layer between layers of the swellable sealing material of a swellable packer, no portion of reinforcement sheet is exposed as part of the outer surface of the wound and inactivated swell packer. In various embodiments, when reinforcement sheet 650 is wound as a layer between layers of the swellable sealing material of a swellable packer, some portion of reinforcement sheet is exposed as a part of the outer surface of the wound and inactivated swell packer, in some embodiments including only a portion of the outer surface of the swell packer, and in other embodiments including all of the outside surface of the swell packer.

As shown in the middle portion of FIG. 6D, reinforcement sheet 654 includes a solid portion 655 that contains no through openings, and a mesh structure 656 that extends over a portion of the reinforcement sheet. Mesh structure 656 includes a plurality of openings that extend through the reinforcement sheet 654, and may be arranged in any pattern, including any shapes, and comprising any of the variations as described above with respect to mesh structure 651.

In various embodiments, when reinforcement sheet 654 is wound as a layer between layers of the swellable sealing material of a swellable packer, no portion of the solid portion 655 of the reinforcement sheet is exposed as part of the outer surface of the wound and inactivated swell packer, while some or all of the mesh structure 656 is exposed as part of the outer surface of the wound and inactivated swell packer.

As shown in the lower portion of FIG. 6D, reinforcement sheet 657 includes a solid section 659 that contains no through openings, and a mesh structure 658 that extends over a remaining portion of the reinforcement sheet. Mesh structure 658 includes a plurality of openings that extend through the reinforcement sheet 657, and may be arranged in any pattern, including any shapes, and comprising any of the variations as described above with respect to mesh structure 651.

In various embodiments, when reinforcement sheet 657 is wound as a layer between layers of the swellable sealing material of a swellable packer, no portion of the mesh structure 658 of the reinforcement sheet is exposed as part of the outer surface of the wound and inactivated swell packer, while some or all of the solid section 659 is exposed as part of the outer surface of the wound and inactivated swell packer.

Figure 7:
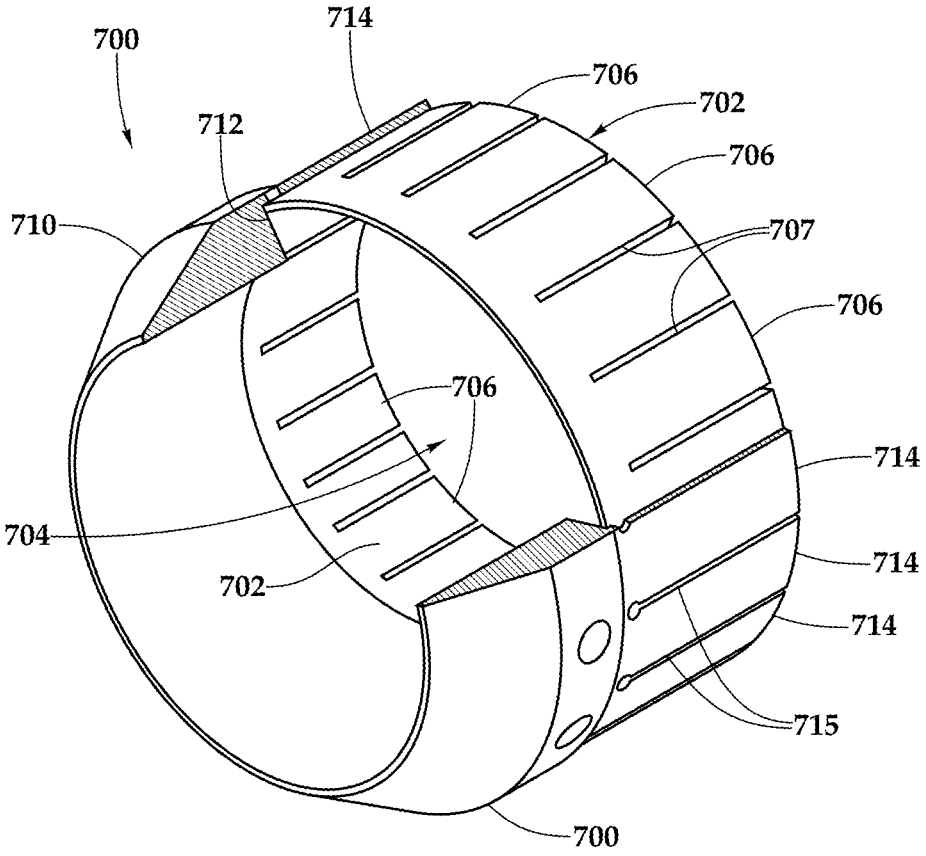
FIG. 7 illustrates a perspective view of an extrusion limitation collar, in accordance with various embodiments.

FIG. 7 illustrates a perspective view of an extrusion limitation collar 700, in accordance with various embodiments. Embodiments of extrusion limitation collar 700 may be utilized in conjunction with the embodiments of the swell packers as described herein, including as extrusion limitation collars 252 and 254 as illustrated and described above with respect to FIGS. 2D-2E.

Referring back to FIG. 7, extrusion limitation collar ("collar") 700 includes a first ring 702 having a cylindrical shape encircling a hollow center area, 704, and comprising a plurality of fingers 706 formed between a plurality of slits 707 that extend partially though the material forming the first ring 702. The fingers 706 extend longitudinally and are circumferentially distributed around the circumference of the first ring 702. The material forming the first ring 702, and therefore the fingers 706, is a flexible material, such as a metal, that is configured to allow the fingers to bend away from the hollow center area 704 of the first ring when acted upon by a force provided from the swelling of an activated swellable elastomeric material of a swell packer when the fingers are partially extend over a top surface of the swellable elastomeric material and the swellable elastomeric material is activated by an activation fluid.

As further shown in FIG. 7, embodiments of collar 700 may include a second ring 710, formed as an outer ring adjacent to and coupled to the first ring 702 by an inset 712. The second ring 710 comprises a cylindrical shape ring that also encircles the hollow center area 704, the second ring comprising a plurality of fingers 714 formed between a plurality of slits 715 that extend partially though the material forming the second ring 710. The fingers 714 of the second ring 710 extend longitudinally and are arranged circumferentially around the circumference of the second ring, and overlap the outer side of the first ring 702. The material forming the second ring 710, and therefore the fingers 714 of the second ring, is a flexible material, such as a metal, that is configured to allow the fingers 714 to bend away from the hollow center area 704 when acted upon by a force provided from the swelling of an activated swellable elastomeric material of a swell packer when the fingers 714 are partially extend over a top surface of the swellable elastomeric material and the swellable elastomeric material is activated by an activation fluid. In various embodiments, the fingers 714 of the second ring 710 are arranged, so that each finger extends across a gap between the fingers 706 of the first ring 702, thereby forming an extrusion barrier to the extrusion of the sealing element over the extrusion limitation collar when positioned adjacent to the swellable elastomeric element of a swell packer during and following activation of the swell packer. In various embodiments, the inner surface and fingers 706 of the first ring may be in direct contact with the sealing element of a swell packer that is positioned to extend into hollow center area 704, and wherein the fingers 714 of the second ring extend over the outer surface and the fingers 706 of the first ring.

Figure 8:
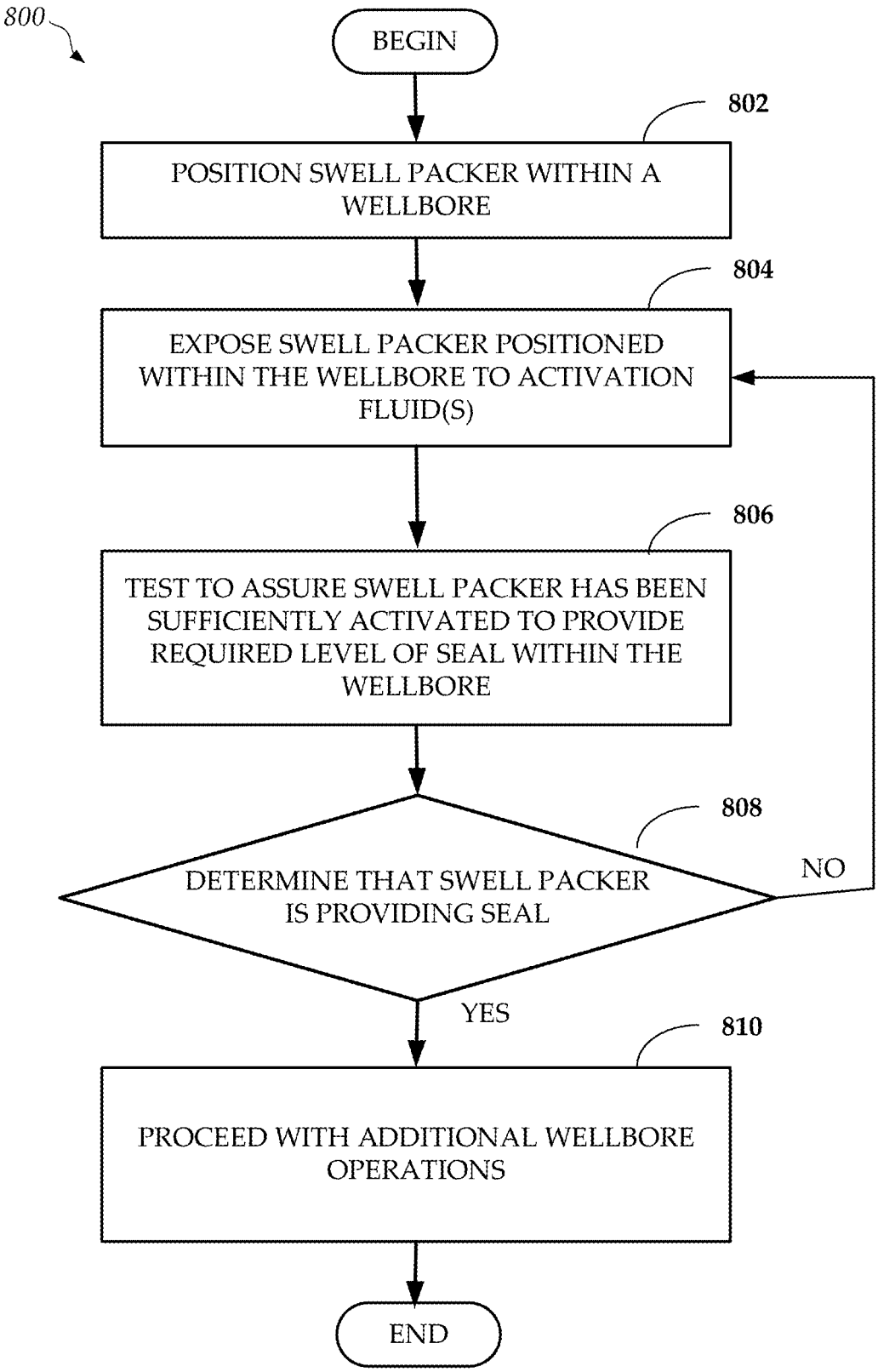
FIG. 8 illustrates a flowchart of a method for setting a swell packer at a downhole location within a wellbore, in accordance with various embodiments.

FIG. 8 illustrates a flowchart of a method 800 for setting a swell packer at a downhole location within a wellbore, in accordance with various embodiments. Embodiments of method 800 may be performed by one or more devices included in a wellbore system, such as system 100 as illustrated and described with respect to FIG. 1. One or more swell packers as described throughout this disclosure, such as swell packer 200 (FIGS. 2A-2C), swell packer 250 (FIGS. 2D-2E), and/or any of the variations of a swell packer as described throughout this disclosure may be utilized in the execution of the steps performed by method 800.

Embodiments of method 800 include positioning a swell packer within a wellbore (block 802). The positioning of the swell packer is performed with the swell packer being provided in an inactivated configuration, such that the swellable sealing member of the swell packer has not been activated to swell due to exposure to an activation fluid. In various embodiments, positioning the swell packer within a wellbore includes the physical coupling of the conduit of the swell packer to one or more additional sections of tubing or conduit in order to allow for the controlled positioning the swell packer at a location within the wellbore where the swell packer is to be activated to form a seal. In various embodiments, positioning of the swell packer within the wellbore may include the use of one or more positioning tools, such as a wellbore tractor, to move the swell packer into position within the wellbore.

Embodiments of method 800 include allowing the swell packer to be exposed to one or more activation fluids (block 804). Allowing the swell packer to be exposed to one or more activation fluids may occur once the swell packer has been positioned at the desired location within the wellbore. Exposure to the activation fluids may occur by adding the activation fluid(s) to the wellbore intentionally. In various embodiments, exposure to the activation fluid(s) may occur due to the present of the activation fluid(s) already being present in the area of the wellbore where the swell packer has been positioned. In various embodiments, exposure of the swell packer to one or more activation fluids may occurs before the swell packer has arrived at the desired position within the wellbore, but the actual swelling process of the swellable sealing material is delayed for example by the fluid barrier that may be provided to protect the outer surface of the swellable sealing material, and/or by the composition of the outer surface of the swellable sealing element, for example by being covered by a layer of the reinforcement material extending out of and around the swellable sealing material as part of the spiral configuration of the sealing element of the swell packer. In various embodiments and depending on the configuration of the swell packer, the time required to allow the swellable sealing element to obtain the fully swelled (activated) condition, may be in a time range referenced from a simulator, corresponding scale testing, from previously run testing, etc.

Embodiments of method 800 include testing to assure the swell packer has swelled to a sufficient level to provide the required seal within the wellbore, casing, or conduit. (block 806). Testing may include tracking a time period for the exposure of the swell packer to the activation fluids based on an expected time period for the swell packer to swell to the full sealing configuration. Testing may include performing one or more pressure tests on the wellbore to confirm that the swell packer is in fact sealing the wellbore in the required manner.

Embodiments of method 800 include determining that the swell packer is providing the desired level of sealing (decision block 808). In various examples, the determination may be made based on the testing performed at block 806 of method 800. If a determination is made at block 808 that the swell packer is not yet providing the required level of sealing (the "NO" branch extending from decision block 808), then embodiments of method 800 may return to block 804, wherein the swell packer continues to be exposed to the activation fluids. If a determination is made at block 808 that the swell packer is in fact providing the required level of sealing, (the YES" branch extending from block 808), then embodiments of method 800 may proceed to block 810.

At block 810, embodiments of method 800 include proceeding with one or more additional wellbore operations based on having the swell packer providing the desired level of seal at the designated location within the wellbore. Embodiments of proceeding with one or more additional wellbore operations may include allow for a fluid flow to occur through an internal passageway provided through the conduit providing the swell packer while blocking any fluid flows from occurring around the outside surface of the conduit due the seal provided by the activated sealing element being expanded between the conduit and another surface adjacent to the swell packer.

Figure 9:
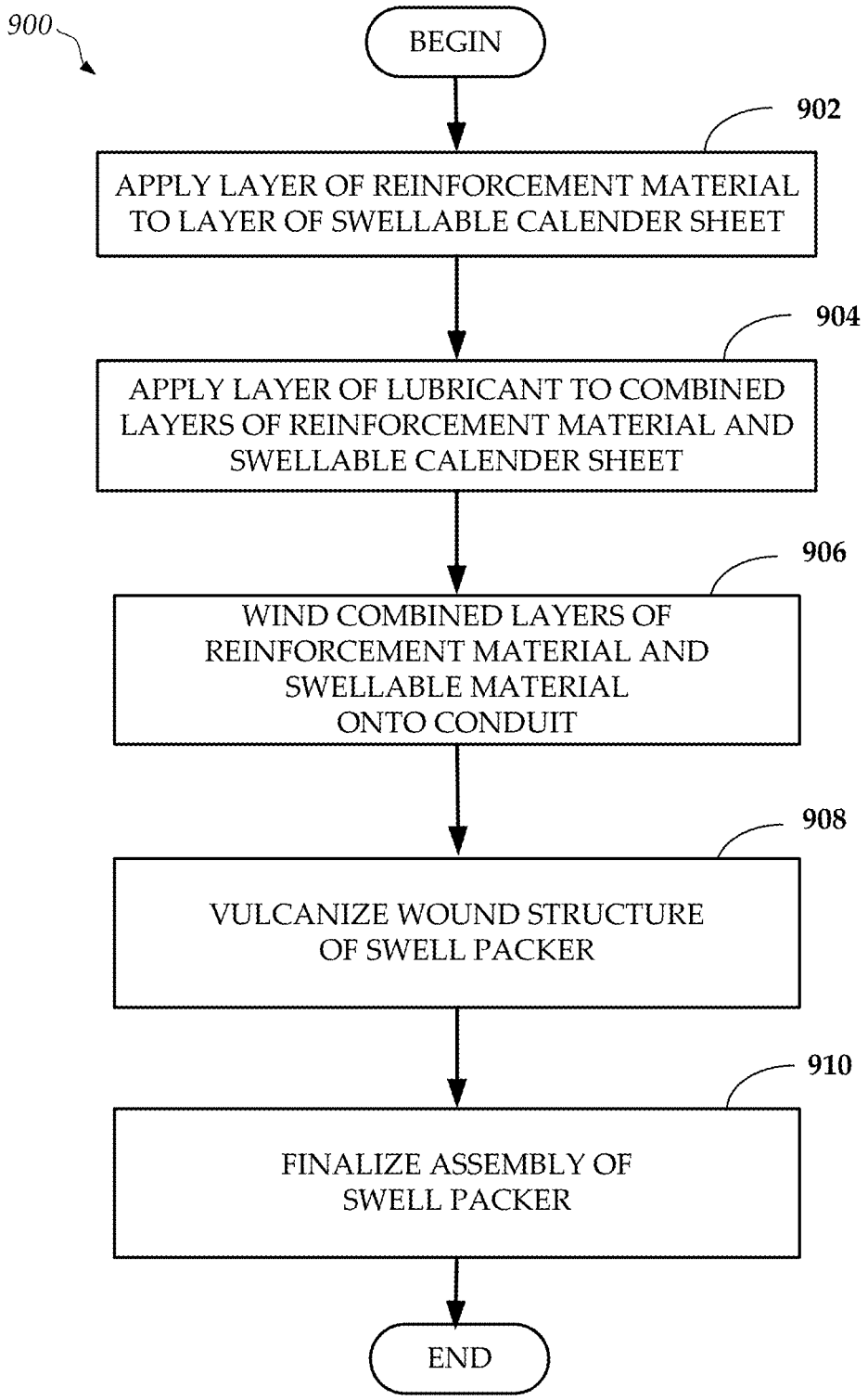
FIG. 9 illustrates a flowchart of a method for manufacturing a swell packer, in accordance with various embodiments.

FIG. 9 illustrates a flowchart of a method 900 for manufacturing a swell packer, in accordance with various embodiments. Embodiments of method 900 may be performed by using a combination of the steps illustrated and described above with respect to process 600 (FIGS. 6A-6C). One or more swell packers as described throughout this disclosure, such as swell packer 200 (FIGS. 2A-2C), swell packer 250 (FIGS. 2D-2E), and/or any of the variations of a swell packer as described throughout this disclosure, may be produced using some combination of the manufacturing processes as described below.

Embodiments of method 900 include applying a layer of reinforcement material to a swellable calender sheet, (block 902). In various embodiments, the sheet of reinforcement material comprises a flexible material such as metal or composite material, and having a bottom surface that is brought into contact with a top surface of the swellable elastomeric material. In various embodiments, the swellable calender sheet is comprised of a swellable elastomeric material, or another material that swells when exposed to a particular activation fluid. A layer of adhesive may be applied to one or both of the layers of the reinforcement sheet and the swellable elastomeric material that are brought into contact with each other in order to adhere these layers together. In various embodiments, a heat and/or pressure process may be applied to the joined layers of the reinforcement sheet and the swellable elastomeric material in order to fuse these layers together.

Embodiments of method 900 include applying a layer of lubricant to the combined layers of the reinforcement material and swellable calender sheet, (bloc 904). In various embodiments, the layer of lubricant is applied, for example using a spraying process, to the top exposed surface of the reinforcement material, such as the metal or composite sheet forming the reinforcement material. The layer of lubrication allows to top surface of the reinforcement material that is brought into contact with a surface of the swellable calender material after winding of the swell packer and during actuation of the sealing element of the swell packer to slide, for example in a rotational direction, relative to one and other, thereby allowing for the spiral configuration of the sealing element to "unwind" and expand radially outward as the swelling of the sealing element is occurring.

Embodiments of method 900 include winding the combined two-layer structure of the reinforcement material and the sheet of elastomeric material around the outer surface of a conduit using multiple overlapping layers of the two layer structure to form a swell packer (block 906). Embodiments of winding the two layer structure onto the conduit may include winding the two layer structure so that only the swellable sealing material is exposed around the entirety of the outer surface of the sealing element. Embodiments of winding the two layer structure onto the conduit may include winding the two layer structure so that some portion of the swellable sealing material is exposed around the outer surface of the sealing element, and some portion of the reinforcement layer is exposed around the outer surface of the sealing element.

Embodiments of winding the two layer structure onto the conduit may include winding the two layer structure so that only the reinforcement layer is exposed around the entirety of the outer surface of the sealing element. In various embodiments, any portions of the reinforcement layer that is exposed around the outer surface of the sealing element may comprise a solid sheet of material, a mesh comprising openings extending through the surface of the sheet of reinforcement material, or some combination of a solid portion and a mesh portion of the reinforcement layer that is exposed around the outer surface of the swell packer.

Embodiments of method 900 include vulcanization of the wound structure of the swell packer (block 908). Vulcanization of the wound structure of the swell packer may include a combination of heat and a pressure treatment applied to the swell packer.

Embodiments of method 900 may include finalization of the assembly of the swell packer (block 910). In various embodiments, finalizing the assembly of the swell packer includes adding end caps to encircle the conduit at the proximal and the distal ends of the swellable sealing element. In embodiments that include two or more swellable sealing elements (i.e., sealing elements 510A, 510B, FIG. 5) wrapped around a common conduit, a center ring may be installed between the individual sealing elements to separate and help secure the swellable sealing elements in place longitudinally along the conduit.

In various embodiments, finalizing the assembly of the swell packer includes processing one or both ends of the conduit of the swell packer, for example to includes threading, to allow the conduit to be physically coupled, at the proximal end, at the distal end, or at both ends of the conduit, to other conduits or tubing sections. In various embodiments, finalizing the assembly of the swell packer includes applying a fluid barrier to the outer surface of the swellable sealing element of the swell packer, the fluid barrier configured to provide a time delay for allowing the activation fluids arriving at the outer surface of the swell packer from contacting the swellable elastomeric material used to form the swellable sealing element. In various embodiments, finalization of the swell packer includes performing a surface treatment, such as mechanical or chemical treatment of the outer surface of the swell packer, to produce a roughened or otherwise non-smooth surface along portions or all of the outer surface of the swellable sealing element of the swell packer, the roughen or otherwise non-smooth surface configured to provide a better grip or improved anchoring capability to the swell packer once the swellable sealing element of the swell packer has been activated and brought into contact with another surface adjacent to the swell packer within a wellbore.

CLOSING NOTES

While the aspects of the disclosure are described with reference to various implementations and exploitations, it will be understood that these aspects are illustrative and that the scope of the claims is not limited to them. In general, techniques for activating downhole apparatus, including a sealing element of a packer as described herein, may be implemented with facilities consistent with any hardware, software, and other system or apparatus as described herein, and any equivalents thereof. Many variations, modifications, additions, and improvements are possible.

Plural instances may be provided for components, operations or structures described herein as a single instance. Finally, boundaries between various components, operations and are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example embodiments include the following.

Embodiment 1. An apparatus comprising: a swell packer comprising a swellable sealing element comprising one or more layers of a swellable material interlayered with a layer of a non-swellable material; wherein the swell packer encircles an outer surface of a conduit along a longitudinal length of the conduit, and wherein the swellable material is configured to expand from a non-expanded configuration to an expanded configuration in order to form a seal between the outer surface of the conduit and an inner surface of a wellbore when the swell packer is positioned downhole within the wellbore and is in a swelled configuration due to exposure to an activation fluid.

Embodiment 2. The apparatus of embodiment 1, wherein the non-swellable material comprises metal.

Embodiment 3. The apparatus of embodiment 1 or 2, wherein the non-swellable material comprises a mesh structure.

Embodiment 4. The apparatus of embodiment 3, wherein at least a portion of the mesh structure is exposed at an outer surface of the swellable sealing element prior to an activation of the swell packer by exposure to the activation fluid.

Embodiment 5. The apparatus of embodiment 4, wherein the portion of the mesh structure that is exposed to the outer surface of the swellable sealing elements comprise a plurality of spikes configured to provide an anchoring grip to the inner surface of the wellbore when the swell packer is positioned downhole within the wellbore and is in the swelled configuration.

Embodiment 6. The apparatus of any one of embodiments 1-5, wherein the swellable material comprises a swellable elastomeric material.

Embodiment 7. The apparatus of any one of embodiments 1-6, wherein an outer surface of the swell packer is coated with a barrier layer, the barrier layer configured to protect the swellable material from exposure to the activation fluid for some period of time once the activation fluid is present at the outer surface of the swell packer.

Embodiment 8. The apparatus of any one of embodiments 1-7, wherein the one or more layers of a swellable material interlayered with the layer of non-swellable material are wound in a spiral pattern in cross-section around the conduit.

Embodiment 9. The apparatus of any one of embodiments 1-8, wherein the swell packer further comprises: a proximal end cap, the proximal end cap secured to the conduit at a position that is longitudinally adjacent to a proximally facing end of the swellable sealing element; and a distal end cap, the distal end cap secured to the conduit at a position that is longitudinally adjacent to a distally facing end of the swellable sealing element.

Embodiment 10. The apparatus of embodiment 9, wherein each one of the proximal end cap and the distal end cap further comprises an extrusion limitation collar having a set of fingers that extend longitudinally over a portion of the outer surface of the swellable sealing element, the fingers configured to prevent extrusion of the swellable sealing element over a top surface of a respective one of proximal end cap and the distal end cap.

Embodiment 11. The apparatus of any one of embodiments 1-10, wherein the swellable sealing element comprises: a first reinforced swellable sealing element positioned at a first longitudinal position along the conduit and a second reinforced swellable sealing element positioned at a second longitudinal position along the conduit, the second longitudinal position longitudinally distal relative to the first longitudinal position.

Embodiment 12. A method for manufacturing a swell packer for use in forming a seal positioned downhole within a wellbore, the method comprising: providing a layer of a swellable material, the layer of swellable material having a sheet configuration including a first width dimension, a first length dimension, and a first sheet thickness dimension, the swellable material in an un-expanded condition; providing a layer of reinforcement material, the layer of reinforcement material having a second length dimension, a second width dimension, and a second sheet thickness dimension, wherein the second width dimension of the reinforcement material is at least as wide at the first width dimension of the swellable material and the second length dimension of the reinforcement material is as long or longer than the first length dimension of the swellable material; positioning a bottom surface of the reinforcement material in contact with a top surface of the swellable material to form a two-part combinational layer of swellable material and reinforcement material; winding the two-part combinational layer of the swellable material and the reinforcement material around a length of a conduit so that the two-part combinational layer of the swellable material and the reinforcement material encircle the conduit in an overlapping set of layers for some longitudinal length of the conduit, each of the overlapping set of layers having each layer of the swellable material separated from any adjacent layers of swellable material by a layers of the reinforcement material; and vulcanizing the two-part combinational layer of the swellable material and the reinforcement material after completing the winding in order to fuse the swellable material within the layers of the reinforcement material.

Embodiment 13. The method of manufacturing the swell packer of embodiment 12, further comprising: applying a lubricating material to a top surface the of the two-part combinational layer prior to performing the winding, the lubricating material configured to allow for rotational movement of individual layers of the two-part combinational layer relative to adjacent layers of the two-part combinational layer after the winding has been completed and as the swellable material of the swell packer is expanding to form a seal following exposure to an activation fluid.

Embodiment 14. The method of manufacturing the swell packer of embodiment 12 or 13, further comprising: after winding of the two-part combinational layer of the swellable material and the reinforcement material around the length of the conduit, applying a barrier layer to an outer surface of the two-part combinational layer, the barrier layer comprising a compound configured to delay an exposure of the swellable material to an activating fluid configure to cause the swellable material to expand once an activation fluid is present at the barrier layer.

Embodiment 15. The method of manufacturing the swell packer of any one of embodiments 12-14, further comprising; positioning a first end cap to encircle the conduit and adjacent to a proximal end of the two-part combinational layer of the swellable material and the reinforcement material following winding of the two-part combinational layer onto the conduit; and positioning a second end cap to encircle the conduit and adjacent to a distal end of the two-part combinational layer of the swellable material and the reinforcement material following winding of the two-part combinational layer onto the conduit.

Embodiment 16. A method comprising: positioning a swell packer in an unexpanded configuration at a location downhole and within a wellbore where a seal between a conduit comprising a body of the swell packer and another surface within the wellbore is to be installed, wherein the swell packer comprises a swellable sealing element comprising one or more layers of a swellable material interlayered with a layer of a non-swellable material, and wherein the swellable sealing element encircles an outer surface of a conduit along a longitudinal length of the conduit, and wherein the swellable sealing element is configured to expand from a non-expanded configuration to an expanded configuration in order to form a seal between the outer surface of the conduit an inner surface of a wellbore when the swell packer is positioned downhole within the wellbore and the swellable sealing element is exposed to an activation fluid; and exposing the swellable sealing element to the activation fluid to expand the swell packer from the non-expanded configuration to the expanded configuration, thereby forming the seal between the outer surface of the conduit and the inner surface of a wellbore.

Embodiment 17. The method of embodiment 16, wherein the non-swellable material comprises metal.

Embodiment 18. The method of embodiment 16 or 17, wherein the non-swellable material comprises a mesh structure.

Embodiment 19. The method of any one of embodiments 16-18, wherein the one or more layers of a swellable material interlayered with the layer of non-swellable material are wound in a spiral pattern in cross-section around the conduit.

Embodiment 20. The method of any one of embodiments 16-19, wherein the swell packer further comprises: a proximal end cap, the proximal end cap secured to the conduit at a position that is longitudinally adjacent to a proximally facing end of the swellable sealing element; and a distal end cap, the distal end cap secured to the conduit at a position that is longitudinally adjacent to a distally facing end of the swellable sealing element.

What is claimed is:

1. An apparatus comprising:

a swell packer comprising a swellable sealing element comprising one or more layers of a swellable material interlayered with a layer of a non-swellable material, with a lubricant layer disposed between the swellable material and the non-swellable material;

wherein the swell packer encircles an outer surface of a conduit along a longitudinal length of the conduit, wherein the swellable material is configured to expand from a non-expanded configuration to an expanded configuration in order to form a seal between the outer surface of the conduit and an inner surface of a wellbore when the swell packer is positioned downhole within the wellbore and is in a swelled configuration due to exposure to an activation fluid, and wherein the lubricant layer enables the swellable sealing element to unwind and expand radially outward as the swelling of the swellable sealing element occurs, and to slide in a rotational direction relative to the non-swellable material.

2. The apparatus of claim 1, wherein the non-swellable material comprises metal.

3. The apparatus of claim 1 wherein the non-swellable material comprises a mesh structure.

4. The apparatus of claim 3, wherein at least a portion of the mesh structure is exposed at an outer surface of the swellable sealing element prior to an activation of the swell packer by exposure to the activation fluid.

5. The apparatus of claim 1, wherein a portion of the non-swellable material that wraps around the swellable material has a rough surface to provide an anchoring grip to the inner surface of the wellbore when the swell packer is positioned downhole within the wellbore and is in the swelled configuration.

6. The apparatus of claim 1, wherein the swellable material comprises a swellable elastomeric material.

7. The apparatus of claim 1, wherein an outer surface of the swell packer is coated with a barrier layer, the barrier layer configured to protect the swellable material from exposure to the activation fluid for some period of time once the activation fluid is present at the outer surface of the swell packer.

8. The apparatus of claim 1, wherein the one or more layers of the swellable material interlayered with the layer of the non-swellable material are wound in a spiral pattern in cross-section around the conduit.

9. The apparatus of claim 1, wherein the swell packer further comprises:

a proximal end cap, the proximal end cap secured to the conduit at a position that is longitudinally adjacent to a proximally facing end of the swellable sealing element; and a distal end cap, the distal end cap secured to the conduit at a position that is longitudinally adjacent to a distally facing end of the swellable sealing element.

10. The apparatus of claim 9, wherein each one of the proximal end cap and the distal end cap further comprises an extrusion limitation collar having a set of fingers that extend longitudinally over a portion of the outer surface of the swellable sealing element, the fingers configured to move radially outward, away from the conduit, as the swellable material expands to prevent extrusion of the swellable sealing element over a top surface of a respective one of proximal end cap and the distal end cap when the swell packer is in the swelled configuration.

11. The apparatus of claim 1, wherein the swellable sealing element comprises: a first reinforced swellable sealing element positioned at a first longitudinal position along the conduit and a second reinforced swellable sealing element positioned at a second longitudinal position along the conduit, the second longitudinal position longitudinally distal relative to the first longitudinal position.

12. The apparatus of claim 1, further comprising an adhesive layer to join the swellable material and the non-swellable material.

13. The apparatus of claim 1, wherein the swellable material is fused to the non-swellable material.

14. The apparatus of claim 1, wherein a two layer structure comprising a layer of the swellable material and a layer of the non-swellable material comprises a ramp to contact the outer surface of the conduit.

15. The apparatus of claim 1, wherein the activation fluid comprises oil.

16. The apparatus of claim 1, wherein the swellable material comprises rubber.

17. The apparatus of claim 1, wherein the non-swellable material comprises permeable sheets comprising composites.

18. The apparatus of claim 1, wherein a portion of the non-swellable material that wraps around the swellable material has a rough surface to provide an anchoring grip to the inner surface of the wellbore or a casing where the swell packer is positioned when the swell packer is in the swelled configuration.

19. The apparatus of claim 1, wherein the non-swellable material has a greater length than the swellable material, the greater length of the non-swellable material wrapping around an outside diameter of the swellable material so as to completely cover an outer surface of the swellable material when the swellable material is in the non-expanded configuration.

20. The apparatus of claim 1, wherein the swell packer comprises proximal and distal end caps to be secured longitudinally in position around the conduit by a respective plurality of fasteners.

21. A method of manufacturing a swell packer, the method comprising:

providing a layer of a swellable material, the layer of swellable material having a sheet configuration including a first width dimension, a first length dimension, and a first sheet thickness dimension, wherein the swellable material is in an un-expanded condition;

providing a layer of reinforcement material, the layer of reinforcement material having a second length dimension, a second width dimension, and a second sheet thickness dimension, wherein the second width dimension of the reinforcement material is at least as wide at the first width dimension of the swellable material and the second length dimension of the reinforcement material is as long or longer than the first length dimension of the swellable material;

positioning a bottom surface of the reinforcement material in contact with a top surface of the swellable material to form a two-part combinational layer of swellable material and reinforcement material;

applying a lubricating material to a top surface of the of the two-part combinational layer; winding the two-part combinational layer of the swellable material and the reinforcement material around a length of a conduit so that the two-part combinational layer of the swellable material and the reinforcement material encircle the conduit in an overlapping set of layers for some longitudinal length of the conduit, each of the overlapping set of layers having each layer of the swellable material separated from any adjacent layers of swellable material by layers of the reinforcement material; and vulcanizing the two-part combinational layer of the swellable material and the reinforcement material after completing the winding in order to fuse the swellable material within the layers of the reinforcement material, the lubricating material configured to allow for rotational movement of individual layers of the two-part combinational layer relative to adjacent layers of the two-part combinational layer after the winding has been completed and as the swellable material of the swell packer is expanding to form a seal following exposure to an activation fluid.

22. The method of manufacturing the swell packer of claim 21, further comprising:

after winding of the two-part combinational layer of the swellable material and the reinforcement material around the length of the conduit, applying a barrier layer to an outer surface of the two-part combinational layer, the barrier layer comprising a compound configured to delay an exposure of the swellable material to the activation fluid configure to cause the swellable material to expand once the activation fluid is present at the barrier layer.

23. The method of manufacturing the swell packer of claim 21, further comprising;

positioning a first end cap to encircle the conduit and adjacent to a proximal end of the two-part combinational layer of the swellable material and the reinforcement material following winding of the two-part combinational layer onto the conduit; and positioning a second end cap to encircle the conduit and adjacent to a distal end of the two-part combinational layer of the swellable material and the reinforcement material following winding of the two-part combinational layer onto the conduit.

24. A method of using a swell packer comprising:

positioning the swell packer in an unexpanded configuration at a location downhole and within a wellbore where a seal between a conduit comprising a body of the swell packer and another surface within the wellbore is to be installed, wherein the swell packer comprises a swellable sealing element comprising one or more layers of a swellable material interlayered with a layer of a non-swellable material, with a lubricant layer disposed between the swellable material and the non-swellable material, wherein the swellable sealing element encircles an outer surface of a conduit along a longitudinal length of the conduit, and wherein the swellable sealing element is configured to expand from a non-expanded configuration to an expanded configuration in order to form a seal between the outer surface of the conduit an inner surface of the wellbore when the swell packer is positioned downhole within the wellbore and the swellable sealing element is exposed to an activation fluid; and exposing the swellable sealing element to the activation fluid to expand the swell packer from the non-expanded configuration to the expanded configuration, thereby forming the seal between the outer surface of the conduit and the inner surface of the wellbore, wherein the lubricant layer enables the swellable sealing element to unwind and expand radially outward as the swelling of the swellable sealing element occurs, and to slide in a rotational direction relative to the non-swellable material.

25. The method of claim 24, wherein the non-swellable material comprises metal.

26. The method of claim 24, wherein the non-swellable material comprises a mesh structure.

27. The method of claim 24, wherein the one or more layers of the swellable material interlayered with the layer of the non-swellable material are wound in a spiral pattern in cross- section around the conduit.

28. The method of claim 24, wherein the swell packer further comprises:

a proximal end cap, the proximal end cap secured to the conduit at a position that is longitudinally adjacent to a proximally facing end of the swellable sealing element; and a distal end cap, the distal end cap secured to the conduit at a position that is longitudinally adjacent to a distally facing end of the swellable sealing element.

* * * * *